US006383704B1

(12) United States Patent
Kataoka et al.

(10) Patent No.: US 6,383,704 B1
(45) Date of Patent: May 7, 2002

(54) FULL COLOR ELECTROPHOTOGRAPHIC TONER, FULL COLOR ELECTROPHOTOGRAPHIC DEVELOPER AND IMAGE FORMING METHOD

(75) Inventors: Rieko Kataoka; Susumu Yoshino; Akihiro Iizuka; Koutarou Yoshihara; Haruhide Ishida; Tetsuya Taguchi; Fumiaki Mera; Hiroshi Takano; Yasuhiro Oya; Michio Take, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/723,241

(22) Filed: Nov. 28, 2000

(30) Foreign Application Priority Data

Jan. 14, 2000 (JP) ..... 2000-006744

(51) Int. Cl.[7] ..... G03G 9/10
(52) U.S. Cl. ..... 430/108.6; 430/45
(58) Field of Search ..... 430/45, 107.1, 430/108.6, 109.4

(56) References Cited

U.S. PATENT DOCUMENTS 5,078,085 A * 1/1992 Fuji et al. ..... 430/122
5,637,427 A * 6/1997 Yamamoto et al. ..... 430/109.4

FOREIGN PATENT DOCUMENTS

| | | | |
|---|---|---|---|
| JP | 58-216252 | A | 12/1983 |
| JP | 60-112052 | A | 6/1985 |
| JP | 60-136755 | A | 7/1985 |
| JP | 4-204750 | A | 7/1992 |
| JP | 4-337738 | A | 11/1992 |
| JP | 5-72797 | A | 3/1993 |
| JP | 5-119517 | A | 5/1993 |
| JP | 5-188633 | A | 7/1993 |
| JP | 5-204183 | A | 8/1993 |
| JP | 6-75430 | A | 3/1994 |
| JP | 6-208241 | A | 7/1994 |
| JP | 7-295293 | A | 11/1995 |
| JP | 8-160659 | A | 6/1996 |

OTHER PUBLICATIONS

Okanishi et al., "Surface Treatment of Ultrafine TiO2 Particles by Vapor–Phase Hydrolysis", Kagaku–Kogaku Ronbunshu, vol. 18, No. 3, pp. 303–307, 1992.

* cited by examiner

*Primary Examiner*—John Goodrow
(74) *Attorney, Agent, or Firm*—Oliff & Berridge, PLC

(57) ABSTRACT

A full color electrophotographic toner including toner particles containing at least a binder resin, a colorant and a wax, and external additives, at least one of the external additives being rutile titanium oxide having a volume resistivity of $1\times10^{14}$ to $1\times10^{18}$ Ωcm, and a dispersion absolute deviation a of rutile titanium oxide being 0.17 or less, and a full color electrophotographic developer and an image forming method using the same are provided. In the full color electrophotographic toner, the full color electrophotographic developer and the image forming method of the invention, a retransfer phenomenon of the transferred toner can be prevented, a chargeability and a transferability are not problematic at all, a charging amount of the toner in long-term use can be rendered appropriate and stable, and a fluidity is also excellent.

16 Claims, 2 Drawing Sheets

FULL COLOR ELECTROPHOTOGRAPHIC TONER, FULL COLOR ELECTROPHOTOGRAPHIC DEVELOPER AND IMAGE FORMING METHOD

FIELD OF THE INVENTION

The present invention relates to a full color electrophotographic toner and a full color electrophotographic developer which are subjected to full color image formation by an electrophotographic method or an electrostatic recording method, and an image forming method.

DESCRIPTION OF THE RELATED ART

Generally, the Carlson method has been so far used in forming an image in a copier or a laser beam printer. In the general image forming method, an electrostatic latent image formed on a surface of a photoreceptor (electrostatic latent image holding member) by an optical unit in an electrostatic latent image forming step is developed in a developing step to form a toner image, the toner image is then transferred onto a recording medium (transfer medium) such as recording paper in a transferring step, and the transferred image is generally fixed on the recording medium with heat and pressure in a fixing step to form the image. Since the photoreceptor is repetitively used, a cleaning device for removing the residual toner remaining on the photoreceptor after the transfer is installed.

Examples of an ordinary electrophotographic developer used to develop an electrostatic latent image formed on a surface of a photoreceptor include a one-component developer made only of a toner obtained by using a resin such as polystyrene, a styrene-butadiene copolymer or a polyester as a binder resin and a pigment or a dye such as carbon black or phthalocyanine blue as a colorant, melt-kneading these and milling the mixture, and a two-component developer obtained by mixing the toner with particles of glass beads, iron, nickel or ferrite having an average particle diameter which is approximately the same as the particle diameter of the toner or a particle diameter of 500 $\mu$m or less or a carrier obtained by coating these particles with various resins. Of these, the two-component developer is excellent because it frictionally charges the toner by stirring the toner and the carrier and the frictional charging amount of the toner can therefore considerably be controlled by selecting the characteristics of the carrier and the stirring conditions and the reliability of the image quality is high.

However, these developers of such structures alone cannot provide satisfactory properties regarding a storage stability (blocking resistance), a transportability, a developability, a transferability and a chargeability. In order to improve these properties, additives such as silica fine particles and titanium oxide, the additives to which surfaces a hydrophobic nature is imparted with an organosilane compound or the additives coated with inorganic oxides have been often externally added (refer to Japanese Patent Laid-Open Nos. 204,750/1992, 208,241/1994, 295,293/1995 and 160,659/1996).

Further, a method has been proposed in which titanium oxide having a low resistance is added as an external additive for controlling the charging by using the conductivity (refer to Japanese Patent Laid-Open Nos. 216,252/1983 and 136,755/1985). The method in which titanium oxide having the low resistance is added has indeed characteristics that it shows a higher charging speed than the method in which silica is added and further titanium oxide has the low resistance, so that the charging distribution becomes sharp. Moreover, these additives are effective for controlling the increase in charge of the developer and inhibiting a ghost phenomenon. However, when such titanium oxide having the low resistance is added, high charging cannot be applied to the toner. Thus, the decrease in the transporting amount due to the successive use, the decrease in the density reproducibility due to the decrease in the charging, the fogging in the background area and the contamination inside the machine tend to occur.

For improving both the charging characteristics and the toner fluidity, a method in which hydrophobic amorphous titanium oxide is added to a toner as an external additive has been proposed (refer to Japanese Patent Laid-Open Nos. 204,183/1993 and 72,797/1993). Amorphous titanium oxide can be obtained by hydrolyzing a metal alkoxide or a metal halide using CVD (refer to *Kagaku-Kogaku Ronbunshu*, vol. 18, No. 3, pp. 303–307 (1992)). Titanium oxide obtained by such a hydrolysis method can indeed improve both the charging properties and the toner fluidity. However, since this titanium oxide contains a large amount of adsorption water within the particles, it remains itself on a photoreceptor in the transfer. That is, owing to a high adhesion to the photoreceptor, amorphous titanium oxide alone remains on the photoreceptor without being transferred. Consequently, there are defects that white spots are generated on an image and hard titanium oxide damages the surface of the photoreceptor in the cleaning.

In addition, for example, Japanese Patent Laid-Open No. 112,052/1985 proposes that anatase titanium oxide is used in a toner as an external additive. However, anatase titanium oxide has a low volume resistivity of approximately $10^7$ Ωcm. When it is used as such, leakage of charging easily occurs especially at high humidity, and it is not necessarily satisfactory in view of a stable chargeability. Thus, its improvement has been in demand.

Problems caused by the external additive having the low resistance include a retransfer phenomenon of a toner after transfer and fogging owing to charge injection from a carrier to a toner. The retransfer phenomenon is a phenomenon in which a toner once transferred onto paper is transferred again onto a photoreceptor or an intermediate transfer medium. This is considered to occur because positive charge for transfer is shifted to a toner having a relatively low resistance with a transfer voltage applied in transferring the toner. Meanwhile, with respect to the injection fogging, positive charge from a carrier is shifted to a toner having a relatively low resistance, and a toner of less negative charge developed consequently causes the fogging on paper.

The retransfer phenomenon is not so problematic in a monochromic image forming method in which the next step proceeds by one transfer. However, it is especially problematic in an image forming method in which primary transfer is repeated plural times according to the number of colors of a color toner and multiple transfer is conducted on a surface of an intermediate transfer medium to obtain a full color toner image. That is, such a retransfer phenomenon tends to occur that a toner (positive toner here) on a surface of an intermediate transfer medium which toner has been transferred with a charging amount or a polarity changed by charge injection is returned to a photoreceptor by an action of a transfer electric field in the transfer of a second color and those following. Consequently, the toner returned to the surface of the photoreceptor by the retransfer phenomenon is removed by a cleaning device. Thus, the decrease in transfer efficiency, and the deterioration of the image quality such as the color change or the color unevenness accompanied by this or the decrease in density finally occur.

On the other hand, in recent years, the high precision and the high image quality have been increasingly demanded in a copier, and attempts have been made to attain the high image quality by decreasing the particle diameter of the toner. However, when the particle diameter is decreased, the charging amount per unit weight tends to be increased, and the image density is decreased or the durability is reduced.

One of the causes is that the developing amount of the toner to the latent image formed on the surface of the photoreceptor is decreased. When the particle diameter of the toner is decreased as stated above, the charging amount per unit weight tends to be increased. Thus, a developing amount of a toner having a small particle diameter tends to be decreased.

The other reason is the decrease in the efficiency at which to transfer the toner image formed on the surface of the photoreceptor onto paper (hereinafter referred to as "transferability"). A toner image formed on a surface of a photoreceptor is generally transferred electrically onto a transfer medium such as paper from the surface of the photoreceptor. When the particle diameter of the toner is decreased, a non-electrostatic adhesion is relatively increased to decrease a transferability. Further, a gravity of one particle is inversely proportional to the cube of the particle diameter. Thus, the fluidity of the toner is much decreased.

It is therefore required that the developer is constructed such that the charging requirement and the requirement of the fluidity can be consistent in the toner having the small particle diameter. However, these requirements cannot be satisfied with only hydrophobic silica fine particles, an external additive ordinarily used. This is because the silica fine particles have themselves a strong negative chargeability. Accordingly, in the toner containing the silica fine particles, the charging amount is greatly changed at a high temperature and high humidity or at a low temperature and low humidity. For example, at a high temperature and high humidity, contamination of a background area with a toner or contamination inside a machine tends to occur. At a low temperature and low humidity, an image density tends to be decreased. In a toner having a small particle diameter, these tendencies are observed more clearly.

Under these circumstances, various investigations have been conducted to effectively use the toner having the small particle diameter in particular.

Japanese Patent Laid-Open No. 348,354/1992 discloses that a good chargeability and a good transferability can be satisfied by combined use of amorphous titania having a relatively small particle diameter and silica having a relatively large particle diameter in a toner having an average particle diameter of 8 $\mu$m or less. Actually, however, with a toner having an average particle diameter of 6 $\mu$m or less, the change in chargeability is relatively great, and this toner is insufficient to obtain a stable chargeability.

Japanese Patent Laid-Open No. 337,738/1992 discloses that inorganic or organic spherical particles having a particle diameter of 20 to 80 nm are added to a toner having an average particle diameter of 9 $\mu$m or less. This is effective for a transferability, but a chargeability is insufficient.

Japanese Patent Laid-Open Nos. 119,517/1993 and 188,633/1993 disclose that silicone-treated titania is used as an external additive in a toner having an average particle diameter of 5 to 10 $\mu$m. In this case, a chargeability is controlled to some extent, but consistence of a fluidity and a transferability cannot be attained.

Japanese Patent Laid-Open No. 75,430/1994 describes that surface-treated anatase titania is added to a toner having an average particle diameter of 3 to 7 $\mu$m. However, consistence of a fluidity and a transferability likewise cannot be attained.

SUMMARY OF THE INVENTION

The invention provides a full color electrophotographic toner, a full color electrophotographic developer and an image forming method in which a retransfer phenomenon of a transferred toner is prevented, a chargeability and a transferability may not be problematic at all, a charging amount of a toner in long-term use can be rendered appropriate and stable and a fluidity is excellent.

The invention relates to a full color electrophotographic toner including toner particles containing at least a binder resin, a colorant and a wax, and external additives, at least one of the external additives being rutile titanium oxide having a volume resistivity of $1\times10^{14}$ to $1\times10^{18}$ $\Omega$cm, and a dispersion absolute deviation $\sigma$ of rutile titanium oxide being 0.17 or less.

Further, the invention relates to a full color electrophotographic developer containing at least a toner and a carrier, the toner being the full color electrophotographic toner of the invention.

Still further, the invention relates to an image forming method which includes at least an electrostatic latent image forming step of forming an electrostatic latent image on a surface of an electrostatic latent image holding member, a developing step of developing the electrostatic latent image formed on the surface of the electrostatic latent image holding member using a layer of a developer formed on a surface of a developer holding member to obtain a toner image on the surface of the electrostatic latent image holding member, a transferring step of transferring the toner image onto a surface of a transfer medium, and a fixing step of fixing the toner image on the surface of the transfer medium, the developer containing the full color electrophotographic developer of the invention.

BRIEF DESCRIPTION OF THE DRAWINGS

Preferred embodiments of the present invention will be described in detail based on the followings, wherein.

DESCRIPTION OF THE PREFERRED EMBODIMENTS

Figure 1:
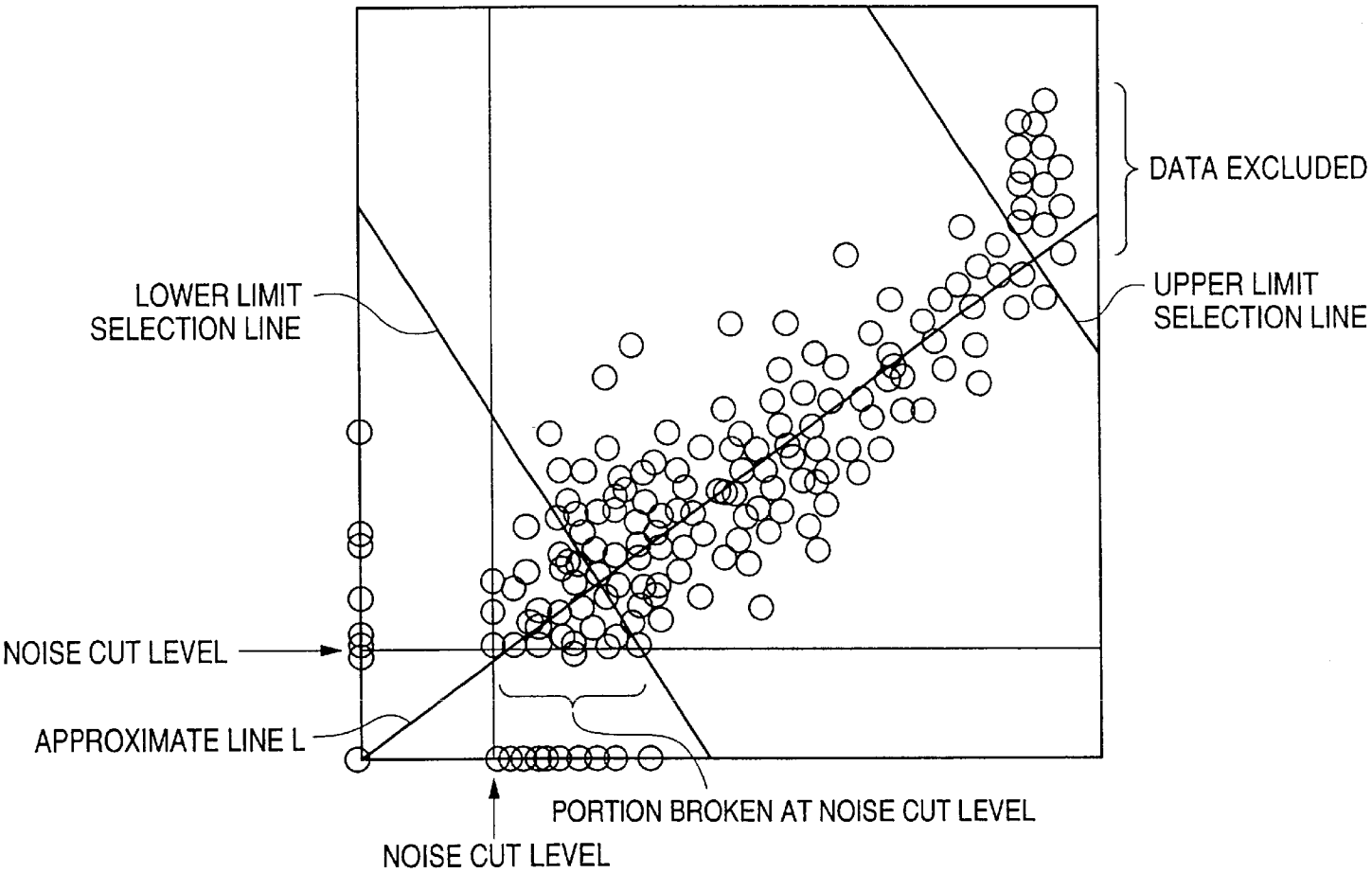
FIG. 1 is a graph for finding a dispersion absolute deviation $\sigma$ in the invention in which concerning each toner in the results of measurement, the abscissa represents a cube root voltage (V) of carbon in a toner and the ordinate represents a cube root voltage (V) of titanium as a main element of rutile titanium oxide and an approximate line L obtained by the method of least squares is drawn from the origin.

The invention is described in detail below.

A: Full Color Electrophotographic Toner (1) Toner Particles

The toner in the invention includes toner particles containing at least a binder resin, a colorant and a wax, and external additives, and further includes other components as required.

(1-1) Binder Resin

Examples of the binder resin used in the invention can include homopolymers or copolymers of styrenes such as styrene and chlorostyrene, monoolefins such as ethylene, propylene, butylene and isoprene, vinyl esters such as vinyl acetate, vinyl propionate and vinyl benzoate, a-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinylmethyl ether, vinylethyl ether and vinylbutyl ether, and vinyl ketones such as vinyl methyl ketone, vinyl hexyl ketone and vinyl isopropenyl ketone. Typical examples of the binder resin can include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene and polypropylene. Further, a polyester, a polyurethane, an epoxy resin, a silicone resin, a polyamide, a modified rosin, a paraffin and a wax can be listed.

Of these resins, the polyester resin is especially preferable because a low-temperature fixability and a transparency are well balanced and a high transparency required for a color toner can be obtained. The polyester resin can be formed from a polyhydric alcohol component and a polybasic carboxylic acid component described below.

Examples of the polyhydric alcohol component can include dihydric alcohols such as ethylene glycol, 1,2-propylene glycol, 1,3-propylene glycol, 1,4-butanediol, 2,3-butanediol, diethylene glycol, triethylene glycol, 1,5-pentanediol, 1,6-hexanediol, neopentylene glycol, 1,4-cyclohexanedimethanol, dipropylene glycol, polyethylene glycol, polypropylene glycol, bisphenol A, hydrogenated bisphenol A and bisphenol A alkylene oxide adducts, for example, polyoxyethylene bisphenol A and polyoxypropylene bisphenol A. Further, a trihydric or higher alcohol can be used for making a polymer non-linear to such an extent that a tetrahydrofuran-insoluble matter is not generated. Examples of the trihydric or higher alcohol component include glycerin, sorbitol, 1,2,3,6-hexanetetraol, 1,4-sorbitan, pentaerythritol, 1,2,4-butanetriol, 1,2,5-pentanetriol, 2-methylpropanetriol, 2-methyl-1,2,4-butanetriol, trimethylolethane, trimethylolpropane and 1,3,5-trihydroxymethylbenzene.

Examples of the polybasic carboxylic acid component can include dibasic carboxylic acids such as maleic acid, fumaric acid, mesaconic acid, citraconic acid, itaconic acid, glutaconic acid, phthalic acid, terephthalic acid, isophthalic acid, cyclohexanedicarboxylic acid, malonic acid, succinic acid, adipic acid, sebacic acid, glutaric acid and alkylsuccinic acids (for example, n-octylsuccinic acid and n-dodecenylsuccinic acid), and acid anhydrides and alkyl esters thereof. In addition to these carboxylic acids, a tribasic or higher carboxylic acid can be used for making a polymer non-linear to such an extent that a tetrahydrofuran-insoluble matter is not generated. Examples thereof can include 1,2,4-benzenetricarboxylic acid, 1,2,5-benzenetricarboxylic acid, 1,2,4-cyclohexanetricarboxylic acid, 1,2,4-naphthalenetricarboxylic acid, 2,5,7-naphthalenetricarboxylic acid, 1,2,4-butanetricarboxylic acid, 1,2,5-hexanetricarboxylic acid, 1,3-dicarboxy-2-methyl-2-carboxymethylpropane, tetra(carboxymethyl) methane, 1,2,7,8-octatetracarboxylic acid, trimellitic acid, pyromellitic acid and lower alkyl esters of these acids.

As the binder resin in the invention, a resin having a softening point of 90 to 150° C., a glass transition point of 55 to 75° C., a number average molecular weight of 2,000 to 6,000, a weight average molecular weight of 8,000 to 150,000, an acid value of 5 to 30 and a hydroxyl value of 5 to 40 is especially preferable. The softening point here referred to is a temperature at a melt viscosity of $10^4$ Pa·s ($10^5$ poise) measured by a flow tester (manufactured by Shimazu Corporation, nozzle 1×1 mm, load 10 kg).

(1-2) Colorant

Typical examples of the colorant of the toner particles in the invention can include carbon black, nigrosine, aniline blue, chalcoyl blue, chrome yellow, ultramarine blue, Du Pont oil red, quinoline yellow, methylene blue chloride, phthalocyanine blue, malachite green oxalate, lamp black, rose bengal, C. I. Pigment·Red 48:1, C. I. Pigment·Red 122, C. I. Pigment·Red 57:1, C. I. Pigment·Yellow 97, C. I. Pigment·Yellow 12, C. I. Pigment-Yellow 17, C. I. Pigment·Yellow 180, C. I. Pigment·Blue 15:1 and C. I. Pigment·Blue 15:3. However, in the invention, these are not critical, and various known colorants can selectively be used depending on the purposes.

(1-3) Wax

Examples of the wax used in the invention include a paraffin wax and derivatives thereof, a montan wax and derivatives thereof, a microcrystalline wax and derivatives thereof, a Fischer-Tropsch wax and derivatives thereof, polyolefin waxes such as polyethylene and polypropylene and derivatives thereof. The derivatives include oxides, polymers with a vinyl monomer and graft-modified products. Further, an alcohol, a fatty acid, a vegetable wax, an animal wax, a mineral wax, an ester wax and an acid amide can also be used.

In the wax used in the invention, it is preferable, in view of the consistence of the improved fixability and the fluidity of the toner powder or the degradation of the toner, that the melt viscosity at 100° C. is 50 mPa·s or less and the rate of penetration at 25° C./100 g is 2 dmm or less. The melt viscosity and the rate of penetration are considered to interact synergistically. With these specific values, the toner particles obtained are quite good in fluidity and fixability.

Generally, the lower the viscosity of the molten wax, the wax is bled out more easily from inside the toner particles. As a result, the offset resistance can be improved advantageously. On the contrary, when the melt viscosity is high, the fluidity and the agglomeration property of the toner are worsened. Consequently, the adhesion state of the external additives to the surface of the toner is rendered unstable, which leads to the contamination of the carrier with the toner by the removal of the external additives.

Further, the determination of the melt viscosity can appropriately control the cohesion of the fixed image immediately after passage through a heating roller and the melt viscosity of the image surface in a low-temperature fixing region and inhibit occurrence of an image scratch by a peeling nail or a peeling nail scar by poor releasing or excessive stress in the releasing. Meanwhile, when the rate of penetration of the wax exceeds 2 dmm, it has sometimes a serious adverse effect, in view of the crystallinity of the wax itself, on the fluidity and the agglomeration resistance of the toner powder. Accordingly, when the predetermined requirement for the rate of penetration is satisfied, the powder fluidity and the agglomeration resistance are good, and the degradation of the toner by the embedding of the additives can be prevented.

In the invention, the melt viscosity of the wax is measured using a dynamic viscometer (Cannon-Fenske viscometer manufactured by Shibata Kagaku Kikai Kogyo). In the viscometer, an elution time is 200 seconds or more. A measuring method is specifically described. First, a molten wax is charged into a constant-temperature bath held at 100° C. It is allowed to stand for 10 minutes or more. After the wax and the viscometer are stable at 100° C., the wax is drawn up and flowed down. The time for which the wax flowed down is measured, and the melt viscosity is calculated. Further, the rate of penetration is measured according to JIS K 2207.

For the melt of the wax to be easily bled out between the toner and a fixing member in the fixing, it is advisable that the melting point of the wax is lower than the softening point of the binder resin. Thus, the melting point of the wax is preferably 120° C. or less in view of the offset resistance, more preferably between 40 and 140° C. in view of a handleability, a simplicity of production and a storage stability, and further preferably between 50 and 120° C.

The molecular weight of the wax greatly influences the melt behavior of the wax itself. Accordingly, for maintaining appropriate fixability and fluidity, the number average molecular weight of the wax used in the invention is preferably between 100 and 1,500, more preferably between 500 and 1,000.

The acid value of the wax used in the invention is preferably 15 or less, more preferably 10 or less. When the acid value exceeds 15, the wax tends to be influenced by environment at a high temperature and high humidity or at a low temperature and low humidity, which leads to deterioration of the image. The molecular weight distribution of the wax is measured by GPC using tetrahydrofuran as a solvent. The acid value can be measured by the method described in JIS K 0070.

In the wax of the invention, it is advisable that the heat absorption starting temperature is 50° C. or more in a DSC curve measured by a differential scanning calorimeter. When the heat absorption starting temperature is less than 50° C., agglomeration of a developer sometimes occurs within a developing device or during storage of the developer. Moreover, the wax is sometimes easily adhered and fused to a member of a developing device such as a developer holding member.

The factors to influence the heat absorption starting temperature are a molecular weight, and a type and an amount of a polar group. Generally, when a molecular weight becomes high, the heat absorption starting temperature is also increased along with a melting point. When the heat absorption starting temperature is increased by this method, a low melting temperature and a low viscosity inherent in a wax are lost. Accordingly, it is effective that the heat absorption starting temperature is increased by a method in which only the waxes having the low molecular weight in the molecular weight distribution of the releasing agent are selectively removed. Specific examples of the method include molecular distillation, solvent fractionation and gas chromatography.

The content of the wax in the toner particles is generally between 1 and 20% by weight, preferably between 1 and 15% by weight, more preferably between 3 and 10% by weight, further preferably between 3 and 6% by weight. When the content of the wax is less than 1% by weight, no satisfactory fixing latitude (fixing roller temperature range in which the toner can be fixed without offset) can be obtained. When it is more than 20% by weight, the amount of the free wax separated from the toner is increased, and the powder fluidity of the toner is worsened. Further, the free wax is adhered to the surface of the photoreceptor on which the electrostatic latent image is formed, and the electrostatic latent image cannot accurately be formed. Since the wax is inferior to the binder resin in the transparency, the transparency of the image of OHP is decreased to form a blackish projected image.

(1-4) Other Components

The toner particles in the invention contain the binder resin, the colorant and the wax as essential components, and as required, other components. Examples of the other components to be added to the toner particles can include an antistatic agent, a fixing aid, a fluidity improving agent, a releasing agent and a cleaning aid. Specifically, a polymethyl methacrylate resin, a polyvinylidene fluoride resin and a higher alcohol can be used, and a commercial product is available as the antistatic agent.

In the invention, it is advisable that the toner particles contain a petroleum resin of a copolymer of an aliphatic hydrocarbon and an aromatic hydrocarbon having 9 or more carbon atoms. With the use of the petroleum resin of the copolymer of the aliphatic hydrocarbon and the aromatic hydrocarbon having 9 or more carbon atoms, the grindability of the toner can be improved to improve the productivity of the toner. Further, since the dispersibility of the releasing agent in the binder resin can be improved, the peelability from the heating roller and the offset resistance can be improved while maintaining the good powder fluidity or the heat storage stability. Thus, occurrence of the image defect of the copy owing to filming of the releasing agent on the photoreceptor or deterioration of charging owing to contamination of a carrier can be inhibited.

The petroleum resin of the copolymer of the aliphatic hydrocarbon and the aromatic hydrocarbon having 9 or more carbon atoms is formed using, as starting materials, diolefins and monoolefins contained in cracked petroleum fractions formed as by-products from an ethylene plant in which ethylene and propylene are produced through steam cracking of petroleums. It is preferably a product obtained by copolymerizing at least one aliphatic hydrocarbon monomer selected from isoprene, piperylene, 2-methylbutene-1 and 2-methylbutene-2 with at least one aromatic hydrocarbon monomer selected from vinyltoluene, α-methylstyrene, indene and isopropenyltoluene.

The use of a pure monomer having a high monomer purity as the aromatic hydrocarbon monomer is preferable because the coloration of the resin obtained or the odor in the heating can be inhibited. The purity of the aromatic hydrocarbon monomer is 95% or more, more preferably 98% or more. The aromatic hydrocarbon monomer is a monomer having 9 or more carbon atoms. The petroleum resin of the copolymer obtained from this monomer and the aliphatic hydrocarbon monomer exhibits a higher compatibility with a polyester resin than a petroleum resin of a copolymer obtained from an aromatic hydrocarbon monomer having less than 9 carbon atoms and an aliphatic hydrocarbon monomer. Further, in order to satisfy the grindability or the heat storage stability of the toner, the larger amount of the aromatic hydrocarbon monomer is preferable in the structure of the copolymer. However, when the amount of the aromatic hydrocarbon monomer is too large, the dispersion of the releasing agent is worsened. Meanwhile, when the amount of the aliphatic hydrocarbon monomer is too large, the heat storage stability is worsened.

The petroleum resin of the copolymer of the aliphatic hydrocarbon and the aromatic hydrocarbon having 9 or more carbon atoms has characteristics that it has a high glass transition point even when it has a low molecular weight and compatibilities with various resins, elastomers and waxes are well-balanced. Both the heat storage stability and the grindability can be provided by melt-blending it with the binder resin, and it does not influence charging properties of the toner.

The amount of the petroleum resin of the copolymer of the aliphatic hydrocarbon and the aromatic hydrocarbon having 9 or more carbon atoms is preferably between 2 and 50% by weight, more preferably between 3 and 30% by weight per 100 parts by weight of the binder resin. When it is less than 2 parts by weight, the effect of improving the dispersibility of the wax is not obtained. When it exceeds 50 parts by weight, the toner particles tend to be excessively ground to decrease the particle diameter of the toner in the developing device. Consequently, there is a fear that fogging might occur, the image density be decreased and the developability be decreased.

(1-5) Production of Toner Particles

The toner particles of the invention can be produced by melt-kneading the colorant, the binder resin, the wax and as required, the other additives with a Banbury mixer, a CM mixer or an extruder, grinding the mixture with a jet mill and classifying the particles with an air classifier. A production method is not particularly limited. A melt kneader, a mill and a classifier which are known can be used, and selected, as required, according to production conditions, purposes or an apparatus used.

(1-6) Properties of the Toner Particles

In the above-formed toner particles of the invention, the volume average particle diameter is preferably between 3 and 9.5 μm, more preferably between 5 and 9.5 μm for forming a vivid image. When the volume average particle diameter is less than 3 μm, it is difficult to provide both the developability and the toner scattering and powder characteristics (fluidity). Meanwhile, when it is larger than 9.5 μm, the high-quality image cannot be obtained.

The amount of the wax on the surfaces of the toner particles in the invention is preferably between 20 and 80%, more preferably between 40 and 65%. When the amount of the wax on the surfaces of the toner particles is too small, hot offset and a finger mark sometimes occur to decrease the fixability of the image. When it is too large, the wax is sometimes shifted to a developing sleeve.

The amount of the wax on the surfaces of the toner particles is controlled by controlling the amount of the wax added and the dispersion diameter of the wax or by the post treatment of the surfaces of the toner particles. When the dispersion diameter of the wax is too large, the toner tends to be ground in a wax domain during the production of the toner particles to increase the amount of the wax on the surfaces of the toner particles. Further, the acid value and the melt viscosity of the wax or the addition of the dispersion aid are also related thereto. A wax having too high an acid value has a high affinity when mixed with a polar resin such as a polyester, and they are dissolved or dispersed too finely. Thus, the wax is not satisfactorily bled out, and no satisfactory fixability is obtained at times.

The amount of the wax on the surfaces of the toner particles is measured by the following method.

First, with respect to toner particles a and toner particles b containing a binder resin, a colorant and as required, other additives except a wax, a ratio of element numbers of carbon and oxygen is measured with XPS (JPS80 manufactured by JEOL, Ltd.). At this time, intensities of respective elements are obtained from peak areas, and the amounts thereof are measured. Peak area intensities of C1s and O1s are used in the measurement.

From the thus-obtained ratio of element numbers of carbon and oxygen, a ratio (atomic %) of carbon is calculated by the following equation (1) on the toner particles a and b.

$$\text{Ratio (\%) of carbon} = Ac/(Ac+Ao)\times 100 \quad (1)$$

wherein Ac represents a ratio (%) of element number of carbon, and Ao represents a ratio (%) of element number of oxygen.

Meanwhile, the ratio (atomic %) of carbon is also measured in case of the wax alone. Regarding the wax alone, the wax as a sample is placed on a sample base, and melted with heat to provide a lubricity, and the ratio (atomic %) of carbon is calculated from the ratio (%) of element numbers of carbon and oxygen measured with XPS using equation (1). Further, using each ratio (atomic %) of carbon obtained, the amount of wax on the surfaces of the toner particles is calculated by the following equation 2.

$$\text{Amount (\%) of wax} = (Ba-Bb)/(W-Bb)\times 100 \quad (2)$$

wherein Ba represents a ratio (atomic %) of carbon in toner particles a, Bb represents a ratio (atomic %) of carbon in toner particles b, and W represents a ratio (atomic %) of carbon in a wax alone.

(2) External Additives

In the invention, as external additives, at least rutile titanium oxide is added as an essential component, and other external additives are further added as required.

(2-1) Rutile Titanium Oxide

In the invention, rutile titanium oxide has externally added as an essential component. Such an external additive is effective when using the toner particles containing the wax. The reason is described below.

The toner particles containing the wax have a good peelability from a heating roller and a good offset resistance, but it has a low compatibility between the wax and the binder resin. Thus, there are defects that the wax forms a large domain in the resin, and in the production of the toner particles, the toner is ground in this domain and the wax is liable to be exposed on the surfaces of the toner particles. Further, when the diameter of the toner particles is reduced to realize a high image quality, the amount of the wax on the surfaces of the toner particles is further increased. When such toner particles are used, the deterioration of the fluidity and the dispersibility and the decrease in the charging tend to occur. Still further, in the development, the wax is shifted to the developer holding member and the photoreceptor (electrostatic latent image holding member), so that the non-uniform toner transportation or the contamination of the photoreceptor occurs to decrease the density or to deteriorate the image quality.

In the invention, therefore, rutile titanium oxide as the external additive exhibits the excellent effects in the fluidity, the dispersibility, the transferability and the chargeability to the wax-containing toner particles. Accordingly, the use of rutile titanium oxide as the external additive can provide the full color electrophotographic toner excellent in the fluidity, the chargeability and the transferability even with the wax-containing toner particles which might cause the embedding or the agglomeration of the external additive or the decrease in the fluidity of the toner itself.

Rutile titanium oxide in the invention has the volume resistibility of $1\times10^{14}$ to $1\times10^{18}$ Ωcm. The determination of the volume resistivity in this range makes it possible to maintain the stable charging over a long term, to prevent the retransfer phenomenon of the transferred toner or the injection fogging, and to impart a chargeability to the same itself.

To describe in more detail, by the determination of the volume resistivity in this range, the positive charge given from the transfer unit is blocked without being injected into the toner because rutile titanium oxide has a relatively high resistance, and the charging amount or the charging polarity of the transferred toner is not changed so much. When the volume resistivity of rutile titanium oxide is lower than $1\times10^{14}$ Ωcm, the charge given from a transfer unit is soon leaked or neutralized. Thus, no satisfactory transfer is conducted, and the charge injection-type fogging or the retransfer phenomenon of the toner after the transfer sometimes occurs. Meanwhile, when it is higher than $1\times10^{18}$ Ωcm, rutile titanium oxide is charged to increase a potential of the electrostatic latent image holding member during the charging step, and the potential of the electrostatic latent image holding member tends to be unstable. The volume resistivity is preferably between $1\times10^{15}$ and $1\times10^{17}$ Ωcm.

In the invention, the volume resistivity is measured as follows.

Rutile titanium oxide (sample) to be measured is placed on a lower plate of a pair of measuring jigs (upper and lower plates), disk plates (made of steel) each having an area of 20 $cm^2$ which are connected with an electrometer (KEITHLEY 610C manufactured by KEITHLEY) and a high-voltage power supply (FLUKE 415B manufactured by FLUKE) so as to form a flat layer having a thickness of approximately 1 to 3 mm. After the upper plate is put on the sample, a weight of 4 kg is placed on the upper plate to eliminate a gap of the plates with the sample interposed. In this state, the thickness of the sample layer is measured. Then, a voltage is applied to both the plates to measure a current value, and a volume resistivity is calculated on the basis of the following formula.

Volume resistivity=applied voltage×20÷(current value−initial current value)÷thickness of sample layer wherein an initial current value is a value when an applied voltage is 0, and a current value is a value measured when a voltage is applied.

In the invention, it is preferable that rutile titanium oxide is needle-like. Needle-like rutile titanium oxide can be contacted on the surface when blended with the toner particles. Thus, the adhesion is good even with a small energy, and rutile titanium oxide is hardly separated from the toner particles. Further, needle-like rutile titanium oxide is effective for securing the specific dispersion absolute deviation a of the invention to be described later.

That rutile titanium oxide is needle-like in the invention indicates that the aspect ratio, namely a long diameter/short diameter ratio, on fine particles of rutile titanium oxide is 5 or more. The aspect ratio is preferably between 10 and 20.

The BET specific surface area of rutile titanium oxide in the invention is preferably between 40 and 120 $m^2/g$, more preferably between 60 and 100 $m^2/g$, further preferably between 70 and 90 $m^2/g$. When the BET specific surface area is in this range, rutile titanium oxide is uniformly adhered to the toner particles, whereby a good fluidity is provided and rutile titanium oxide is not embedded in the toner particles nor separated therefrom even in the repetitive use. Further, the BET specific surface area of rutile titanium oxide in this range is effective for securing the specific dispersion absolute deviation $\sigma$ of the invention to be described later.

To describe in more detail, rutile titanium oxide having the BET specific surface area in this range is good in its own fluidity and dispersibility. Consequently, when rutile titanium oxide is blended with the toner particles, it can uniformly be coated on the surfaces of the toner particles without agglomeration of rutile titanium oxide. When the BET specific surface area is smaller than 40 $m^2/g$, the fluidity is sometimes decreased. When the BET specific surface area is larger than 120 $m^2/g$, the photoreceptor is sometimes damaged, and the image quality tends to be decreased.

In the invention, the BET specific surface area is a value measured by a nitrogen adsorption method. For example, it can be measured by a circulation-type nitrogen adsorption BET 1-point method using Quantasorb Model QS-16 (manufactured by Quantachrome). That is, rutile titanium oxide (sample) to be measured is deaerated at 200° C. for 15 minutes in a 100% $N_2$ gas stream. The sample is cooled to a liquid nitrogen temperature. After $N_2$ is adsorbed by passing an He/$N_2$ (30% $N_2$) mixed gas, $N_2$ adsorbed is removed at room temperature. $N_2$ removed is measured with a heat conductivity detector, and a total surface area thereby calculated is expressed as a ratio of the sample per gram of dry weight of the sample.

In the invention, the hydrophobicity of rutile titanium oxide is preferably between 40 and 100%, more preferably between 50 and 90%, further preferably between 60 and 90%. When the hydrophobicity is too low, a fine powder containing a large amount of an agglomerate is formed, which results in the decrease in the toner fluidity or the decrease in the charging owing to the water adsorption especially at a high temperature and high humidity and further the deterioration owing to the environmental difference in the wax-containing toner of the invention. When the hydrophobicity is too high, a surface treating agent has to be used in a large amount, and a treated fine powder containing a large amount of an agglomerate is therefore formed.

In the invention, the hydrophobicity of rutile titanium oxide is measured by a methanol titration test method as described below.

Rutile titanium oxide (sample, 0.2 g) to be measured is added to 50 ml of water charged in a 250-ml Erlenmeyer flask. Methanol is titrated from a buret until the total amount of the sample is swollen. At this time, the solution in the flask is always stirred with a magnetic stirrer. The end point is observed such that the total amount of the sample is suspended in the liquid, and the hydrophobicity is expressed as a percentage (on the weight basis) of methanol in the liquid mixture of methanol and water when the end point is reached.

The average primary particle diameter of rutile titanium oxide in the invention is preferably between 5 and 25 nm, more preferably between 7 and 20 nm.

When the average primary particle diameter is too small, agglomeration of rutile titanium oxide occurs. There is a fear that no uniform dispersion might occur and charge exchangeability be decreased or the durability become poor owing to embedding of rutile titanium oxide in the toner particles. Meanwhile, when the average primary particle diameter is too large, the charging of the toner becomes unstable due to the poor fluidity or the separation from the toner particles. Consequently, fogging sometimes occurs.

The particle size of the toner used in the invention is measured using a particle size measuring unit TA-II manufactured by Coulter Counter with an aperture diameter of 100 $\mu$m.

It is advisable that rutile titanium oxide in the invention is surface-treated with at least one silicon compound (coupling agent) selected from the group consisting of silicon compounds represented by formulas (I) to (III).

$$R_1Si(X)_3 \quad \text{(I)}$$

$$R_1R_2Si(X)_2 \quad \text{(II)}$$

$$R_1R_2R_3SiX \quad \text{(III)}$$

wherein $R_1$ represents an alkyl group having 1 to 20 carbon atoms or a perfluoroalkyl group having 1 to 20 carbon atoms, $R_2$ and $R_3$ each represent a hydrogen atom, an alkyl group having 1 to 20 carbon atoms, a perfluoroalkyl group having 1 to 20 carbon atoms or an aryl group having 6 to 20 carbon atoms, and X represents a chlorine atom, an alkoxy group, NCO or an acetoxy group.

The effects such as the prevention of comet or filming on the surface of the photoreceptor, the dispersibility or the adhesion to the toner particles, the charging stability accompanied by controlling the hydrophobicity and the charge exchangeability are all the more expected by this surface treatment.

Examples of the treating agent used in the surface treatment are as follows.

Examples of the compound represented by formula (I):

$CH_3Si(Cl)_3$, $CH_3Si(OCH_3)_3$, $CH_3Si(OC_2H_5)_3$, $CH_3CH_2Si(OCH_3)_3$, $CH_3(CH_2)_2Si(OCH_3)_3$, $CH_3(CH_2)_3Si(OCH_3)_3$, $CH_3(CH_2)_4Si(OCH_3)_3$, $CH_3(CH_2)_5Si(OCH_3)_3$, $CH_3(CH_2)_6Si(OCH_3)_3$, $CH_3(CH_2)_7Si(OCH_3)_3$, $CH_3(CH_2)_8Si(OCH_3)_3$, $CH_3(CH_2)_9Si(OCH_3)_3$, $CH_3(CH_2)_{10}Si(OCH_3)_3$, $CH_3(CH_2)_{11}Si(OCH_3)_3$, $CH_3(CH_2)_{12}Si(OCH_3)_3$, $CH_3(CH_2)_{13}Si(OCH_3)_3$, $CH_3(CH_2)_{14}Si(OCH_3)_3$, $CH_3(CH_2)_{15}Si(OCH_3)_3$, $CH_3(CH_2)_{16}Si(OCH_3)_3$, $CH_3(CH_2)_{17}Si(OCH_3)_3$, $CH_3(CH_2)_{18}Si(OCH_3)_3$, $CH_3(CH_2)_{19}Si(OCH_3)_3$, $CH_3(CH_2)_5Si(OC_2H_5)_3$, $CH_3(CH_2)_6Si(OC_2H_5)_3$, $CH_3(CH_2)_7Si(OC_2H_5)_3$, $CH_3(CH_2)_8Si(OC_2H_5)_3$, $CH_3(CH_2)_9Si(OC_2H_5)_3$, $CH_3(CH_2)_{10}Si(OC_2H_5)_3$, $CH_3(CH_2)_{11}Si(OC_2H_5)_3$, $CH_3(CH_2)_{12}Si(OC_2H_5)_3$, $CH_3(CH_2)_{13}Si(OC_2H_5)_3$, $CH_3(CH_2)_{14}Si(OC_2H_5)_3$, $CH_3(CH_2)_{15}Si(OC_2H_5)_3$, $CH_3(CH_2)_{16}Si(OC_2H_5)_3$, $CH_3(CH_2)_{17}Si(OC_2H_5)_3$, $CH_3(CH_2)_{18}Si(OC_2H_5)_3$, $CH_3(CH_2)_{19}Si(OC_2H_5)_3$, $CF_3Si(OCH_3)_3$ and $CH_3Si(NCO)_3$ Examples of the compound represented by formula (II):

$(CH_3)_2SiCl_2$, $(CH_3)_2Si(OCH_3)_2$, $(CH_3)_2Si(OC_2H_5)_2$, $(CH_3)(CH_3C_2)Si(OH_3)_2$, $(CH_3)[CH_3(CH_2)_2]Si(OCH_3)_2$, $(CH_3)[CH_3(CH_2)_3]Si(OCH_3)_2$, $(CH_3)[CH_3(CH_2)_4]Si(OCH_3)_2$, $(CH_3)[CH_3(CH_2)_5]Si(OCH_3)_2$, $(CH_3)[CH_3(CH_2)_6]Si(OCH_3)_2$, $(CH_3)[CH_3(CH_2)_7]Si(OCH_3)_2$, $(CH_3)[CH_3(CH_2)_8]Si(OCH_3)_2$, $(CH_3)[CH_3(CH_2)_9]Si(OCH_3)_2$, $(CH_3)[CH_3(CH_2)_{10}]Si(OCH_3)_2$, $(CH_3)[CH_3(CH_2)_{11}]Si(OCH_3)_2$, $(CH_3)[CH_3(CH_2)_{12}]Si(OCH_3)_2$, $(CH_3)[CH_3(CH_2)_{13}]Si(OCH_3)_2$, $(CH_3)[CH_3(CH_2)_{14}]Si(OCH_3)_2$, $(CH_3)[CH_3(CH_2)_{15}]Si(OCH_3)_2$, $(CH_3)[CH_3(CH_2)_{16}]Si(OCH_3)_2$, $(CH_3)[CH_3(CH_2)_{17}]Si(OCH_3)_2$, $(CH_3)[CH_3(CH_2)_{18}]Si(OCH_3)_2$, $(CH_3)[CH_3(CH_2)_{19}]Si(OCH_3)_2$, and $(CH_3)_2Si(NCO)_2$ Examples of the compound represented by formula (III):

$(CH_3)_3SiCl$, $(CH_3)_3Si(OCH_3)$, $(CH_3)_3Si(OC_2H_5)$, $(CH_3)_2(CH_3CH_2)Si(OCH_3)$, $(CH_3)_2[CH_3(CH_2)_2]Si(OCH_3)$, $(CH_3)_2[CH_3(CH_2)_3]Si(OCH_3)$, $(CH_3)_2[CH_3(CH_2)_4]Si(OCH_3)$, $(CH_3)_2[CH_3(CH_2)_5]Si(OCH_3)$, $(CH_3)_2[CH_3(CH_2)_6]Si(OCH_3)$, $(CH_3)_2[CH_3(CH_2)_7]Si(OCH_3)$, $(CH_3)_2[CH_3(CH_2)_8]Si(OCH_3)$, $(CH_3)_2[CH_3(CH_2)_9]Si(OCH_3)$, $(CH_3)_2[CH_3(CH_2)_{10}]Si(OCH_3)$, $(CH_3)_2[CH_3(CH_2)_{11}]Si(OCH_3)$, $(CH_3)_2[CH_3(CH_2)_{12}]Si(OCH_3)$, $(CH_3)_2[CH_3(CH_2)_{13}]Si(OCH_3)$, $(CH_3)_2[CH_3(CH_2)_{14}]Si(OCH_3)$, $(CH_3)_2[CH_3(CH_2)_{15}]Si(OCH_3)$, $(CH_3)_2[CH_3(CH_2)_{16}]Si(OCH_3)$, $(CH_3)_2[CH_3(CH_2)_{17}]Si(OCH_3)$, $(CH_3)_2[CH_3(CH_2)_{18}]Si(OCH_3)$ and $(CH_3)_2[CH_3(CH_2)_{19}]Si(OCH_3)$ Of these, the compounds represented by formula (I) are preferable, and $CH_3(CH_2)_nSi(OCH_3)_3$ (n=5 to 19) is especially preferable, in view of the increase in the charging amount. Further, for the same reason, the compounds in which $R_1$ is an alkyl group or a perfluoroalkyl group having 7 to 16 carbon atoms are preferable.

With respect to the surface treatment with the silicon compound (coupling agent), for example, a method in which fine particles of rutile titanium oxide are dipped in a solution containing the coupling agent and dried is preferable because a uniform coating can be formed. The amount of the silicon compound is preferably between 0.1 and 25% by weight, more preferably between 1 and 20% by weight based on the fine particles of rutile titanium oxide.

Generally, in the production of titanium oxide by an ordinary wet method, a chemical reaction is conducted in a solvent. This method includes a sulfuric acid method and a hydrochloric acid method. In the sulfuric acid method, the following reaction proceeds in a liquid phase. Insoluble $TiO(OH)_2$ is obtained by hydrolysis, washed with water, filtered, and then burned at 400 to 1,000° C. to give $TiO_2$. This is shown by the following chemical reaction formula.

$$FeTiO_3+2H_2SO_4 \rightarrow FeSO_4+TiOSO_4+2H_2O \quad TiOSO_4+2H_2O \rightarrow TiO(OH)_2+H_2SO_4 \quad TiO(OH)_2 \rightarrow TiO_2+H_2O \text{ (burning)}$$

Further, in the hydrochloric acid method, chlorination is conducted as in a dry method to form titanium tetrachloride. This compound is then dissolved in water, and hydrolysis is conducted while charging a strong base therein to obtain $TiO(OH)_2$. It is washed with water, filtered, and burned at 400 to 1,000° C. to obtain $TiO_2$. This is shown by the following chemical reaction formula.

$$TiC_4+H_2O \rightarrow TiOCl_2+2HCl \quad TiOC_2+2H_2O \rightarrow TiO(OH)_2+2HCl \quad TiO(OH)_2 \rightarrow TiO_2+H_2O \text{ (burning)}$$

In the wet method, the particle size is controlled by controlling the pH, the reaction temperature and the reaction time, whereby the crystal form and the specific surface area can be adjusted. Further, the specific surface area can be increased by grinding to form amorphous particles. Titanium oxide takes the three crystal forms of rutile, anatase and brookite. In the invention, rutile titanium oxide has to be used from the aspects of the fluidity and the dispersibility.

Further, the dispersion absolute deviation a of rutile titanium oxide in the invention has to be 0.17 or less. It is preferably 0.15 or less, more preferably 0.13 or less. When the dispersion absolute deviation $\sigma$ is 0.17 or less, rutile titanium oxide is uniformly present on the surfaces of the toner particles, and a sharp charging distribution can be exhibited as a whole without agglomerating the external additives and the toner particles. Such a highly dispersed state makes it possible to improve the chargeability of rutile titanium oxide and to prevent the retransfer phenomenon or the injection fogging more effectively.

The dispersion absolute deviation $\sigma$ is an index that indicates the dispersibility of rutile titanium oxide in the toner particles. The toner (toner particles to which at least rutile titanium oxide is adhered as an external additive) to be measured is introduced into plasma to excite the same and emit light. The luminosity is measured. The results of the measurement are plotted in a graph in which the abscissa represents a cube root voltage (V) of carbon in the toner and the ordinate represents a cube root voltage (V) of titanium as a main element of rutile titanium oxide. It indicates a value of absolute deviation of an error relative to an approximate line calculated by the method of least squares and drawn from the origin. The dispersion absolute deviation $\sigma$ refers to unevenness of a measurement distribution. Thus, the smaller the value, rutile titanium oxide is adhered to the toner particles more uniformly.

A specific method of measuring the dispersion absolute deviation $\sigma$ in the invention is described below.

Toners to be measured which are trapped with a membrane filter (polycarbonate, 0.4 $\mu$m) are sucked up one by one with a special aspirator using an He gas as a carrier, and introduced into He microwave-induced plasma (He-MIP: high-temperature specific heat equilibrium plasma having an electron density of $5\times10^{13}$ $cm^3$, an excitation temperature of 3,300 K and a high electron temperature exceeding 20,000 K). The toner is here evaporated, resolved into atoms, ionized, and excited to emit light. The intensity of the emission spectrum is measured using a particle analyzer (PT1000 manufactured by Yokokawa Electric Works, Ltd.).

The respective toners in the results of the measurement are plotted in a graph in which the abscissa represents a cube root voltage (V) of carbon in the toner and the ordinate represents a cube root voltage (V) of titanium as a main element of rutile titanium oxide. Further, an approximate line L calculated by the method of least squares is drawn from the origin. Thus, a graph shown in FIG. 1 is completed.

When the approximate line L is calculated, particles with Y=0 in the ordinate (particles to which rutile titanium oxide as an external additive is not adhered at all) and particles with X=0 in the abscissa (particles made only of rutile titanium oxide as an external additive) are excluded as particles which fail to fall under the limit of measurement.

From the resulting graph, the following error value x is calculated on the respective toners.

$$\text{Error value } x=d/H$$

wherein d represents a length of a perpendicular S drawn in an approximate line L from a data point of each toner, and H represents a length of a perpendicular T drawn in an X axis from a toe of the perpendicular S (intersection of the perpendicular S and the approximate line L).

Figure 2:
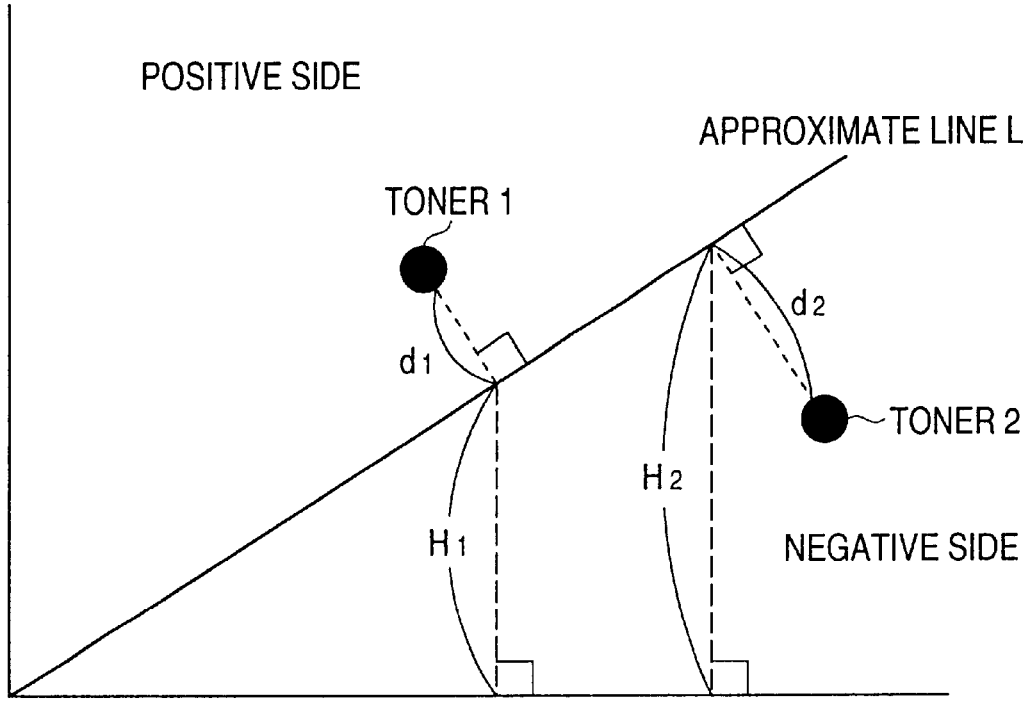
FIG. 2 is a graph for describing a method of obtaining a dispersion absolute deviation $\sigma$ in the invention in which only two points of the results of measurement in the graph of FIG. 1 are depicted.

Specifically, as shown in FIG. 2, the error value x, on the data of the toner 1 and the error value $x_2$ on the data of the toner 2 are represented by the following formulas respectively.

$$\text{Error value } x_1=d_1/H_1$$

$$\text{Error value } x_2=d_2/H_2$$

The error values x are calculated on the data of all the toners in the selected range, and the average x' thereof is obtained. Further, the value of the absolute deviation of the error, namely, the dispersion absolute deviation a in the invention is calculated according to the following formula.

$$\text{Dispersion absolute deviation } \sigma=\Sigma|x-x'|/n$$

wherein n represents a total number of the data of the error values (total number of toners measured).

Further, with respect to rutile titanium oxide in the invention, the coating rate of the same to the surfaces of the toner particles is preferably between 20 and 100%, more preferably between 30 and 80%, further preferably between 40 and 60%. When the coating rate is too low, no satisfactory effects of the invention can be obtained. Meanwhile, when the coating rate is too high, rutile titanium oxide tends to be separated from the surfaces of the toner particles, and problems such as contamination or damage of the surface of the photoreceptor, contamination of the carrier surface and contamination within a machine sometimes occur.

In the invention, the coating rate f(%) of rutile titanium oxide to the surfaces of the toner particles is defined by the following formula.

$$f=\sqrt{3}\times dt\times Pt\times C/(2\pi\times da\times Pa)$$

wherein dt represents an average volume particle diameter ($\mu$m) of toner particles, Pt represents a true specific gravity of toner particles, da represents an average primary particle diameter ($\mu$m) of fine particles of rutile titanium oxide, Pa represent a true specific gravity of rutile titanium oxide, and C represents a ratio of a weight x (g) of rutile titanium oxide to a weight y (g) of toner particles (x/y ratio).

(2-2) Other External Additives

In recent years, a high image quality has been increasingly demanded. Accordingly, a particle diameter of a toner tends to be reduced. In order to improve bad transfer accompanied by increasing the adhesion owing to the reduction of the particle diameter, fine particles of silica or titanium oxide having a larger particle diameter than rutile titanium oxide are used as a second external additive (transfer aid). The invention can also be applied to the case of adding the second external additive having the larger particle diameter.

For example, the use of titanium oxide having a larger particle diameter and rutile titanium oxide of the invention in combination can prevent the low charging, the environmental dependence and the decrease in the admixture (broadening of the charging distribution due to the long-term repetitive use) that occur by the addition of the second external additive, and can provide the good transferability without decreasing the chargeability due to the long-term stress generated by peeling off the surface treating agent.

Examples of the second external additive include fine particles made of metallic oxides such as silica (silicon oxide), titanium oxide, tin oxide, zirconium oxide, tungsten oxide and iron oxide, nitrides such as titanium nitride and titanium compounds. Fine particles of hydrophobic silica are preferable.

A hydrophobic nature is imparted by the treatment with a hydrophobic agent. Silicone oil is preferably used as the hydrophobic agent. Examples of the silicone oil include dimethyl silicone oil, alkyl-modified silicone oil, $\alpha$-methylsulfone-modified silicone oil, chlorophenylsilicone oil and fluorine-modified silicone oil. However, the hydrophobic agent in the invention is not limited to the silicone oils alone.

The hydrophobic nature can be imparted with silicone oil by a known method. Examples thereof include a method in which silicic acid is mixed with silicone oil using a mixer, a method in which silicone oil is sprayed in silicic acid using a spray and a method in which silicone oil is dissolved in a solution, and then mixed with silicic acid. However, these methods are not critical.

As the hydrophobic agent, chlorosilane, alkoxysilane, silazane and silylated isocyanate are also available. Specific examples thereof can include methyltrichlorosilane, dimethyldichlorosilane, trimethylchlorosilane, methyltrimethoxysilane, dimethyldimethoxysilane, methyltriethoxysilane, dimethyldiethoxysilane, isobutyltrimethoxysilane, decyltrimethoxysilane, hexamethyldisilazane, ter-butyldimethylchlorosilane, vinyltrichlorosilane, vinyltrimethoxysilane and vinyltriethoxysilane.

When fine particles made of hydrophobic silica are used as the second external additive, the average primary particle diameter of the fine particles is preferably between 10 and 70 nm, more preferably between 20 and 60 nm.

In the full color electrophotographic toner of the invention, besides rutile titanium oxide and the second external additive, an inorganic powder and a resin powder can be added either singly or in combination to the surface of the toner for improving the long-term storage stability, the fluidity, the developability and the transferability of the toner. Examples of the inorganic powder include carbon black, alumina and zinc oxide. Examples of the resin powder include spherical particles of PMMA, nylon, melamine, benzoguanamine and fluorine, and amorphous powders of vinylidene chloride and fatty acid metal salts.

(2-3) Preferable Combination of External Additives

In the invention, rutile titanium oxide is added as an essential external additive, and silica fine particles as a second external additive. It is advisable that the amount of the silica fine particles is between 0.8 and 5.5% by weight based on the toner particles, the amount of rutile titanium oxide is between 0.8 and 3% by weight based on the toner particles, and the total coating rate of silica fine particles and rutile titanium oxide to the surfaces of the toner particles is between 80% and 110%.

The two or more types of the external additives are added and the amounts thereof and the coating rate are defined as described above, whereby the chargeability, the storage stability and the fluidity of the resulting toner can be improved. When the total coating rate of silica fine particles and rutile titanium oxide to the surfaces of the toner particles is 80% or more, the agglomeration and the adhesion of the toner are decreased even in case of a large amount of the wax exposed on the surfaces of the toner particles because the surfaces of the toner particles are coated with the external additives. Thus, it is desirable in the powder characteristics, especially the fluidity. Although the inner temperature of the machine is raised, the fusion and the self-agglomeration of the toner can be inhibited. On the other hand, when the coating rate exceeds 110%, the external additives tend to be separated and adhered to the inside of the developing device to have an adverse effect on the charging of the developer. Thus, it is unwanted. Further, problems might occur that the elution of the wax is blocked in the fixing to cause offset and also the strength or the gloss of the fixed image is decreased.

(3) Production of a Toner

The full color electrophotographic toner of the invention is produced by mixing the toner particles with the external additives. The mixing can be conducted with a V-type blender, a Henschel mixer. Further, coarse particles of the toner may be removed using a vibrating screen classifier or an air classifier as required.

B: Full Color Electrophotographic Developer (1) Carrier

The full color electrophotographic toner of the invention is mixed with a carrier to form a two-component electrostatic latent image developer (full color electrophotographic developer).

The carrier which is preferably used with the full color electrophotographic toner of the invention is not particularly limited. Examples thereof can include magnetic particles of iron, ferrite, iron oxide and nickel; resin-coated carrier particles obtained by coating surfaces of magnetic particles as a core with a known resin such as a styrene resin, a vinyl resin, an ethyl resin, a rosin resin, a polyester resin or a methyl resin to form a resin coating layer; and carrier particles obtained by dispersing magnetic fine particles in a binder resin.

Of these, resin-coated carrier particles obtained by forming a resin coating layer on a core are especially preferable because the chargeability of the toner or the resistance of the overall carrier can be controlled by the resin coating layer.

Examples of the particles as the core of the carrier include magnetic particles of ferrite, magnetite, iron, cobalt and nickel showing ferromagnetism. Of these, ferrite particles having a low specific gravity are preferable for further inhibiting peeling of the resin coating layer or contamination of the toner on the carrier surface due to stresses applied within the developing device. The ferrite particles are preferably magnetic fine particles obtained by using an oxide of at least one element selected from Li, Mg, Ca, Mn, Ni, Cu and Zn and $Fe_2O_3$ as main components, pulverizing them and sintering the particles, more preferably magnetic fine particles obtained by using an oxide of at least one element selected from Li, Mg and Mn and $Fe_2O_3$ as main components, pulverizing them and sintering the particles.

The resin in the resin coating layer of the carrier can be selected from all resins which have been so far used in the art as a material of the resin coating layer of the carrier. The resins may be used either singly or in combination.

Specific examples thereof include polyolefin resins such as polyethylene and polypropylene; polyvinyl and polyvinylidene resins such as polystyrene, an acrylic resin, polyacrylonitrile, polyvinyl acetate, polyvinyl alcohol, polyvinyl butyral, polyvinyl chloride, polyvinyl carbazole, polyvinyl ether and polyvinyl ketone; a vinyl chloride-vinyl acetate copolymer; a styrene-acrylic acid copolymer; a straight silicon resin made of an organosiloxane bond and its modified product; fluororesins such as polytetrafluoroethylene, polyvinyl fluoride, polyvinylidene fluoride and polychlorotrifluoroethylene; polyesters; polyurethanes; polycarbonates; phenol resins; amino resins such as a urea-formaldehyde resin, a melamine resin, a benzoguanamine resin, an urea resin and a polyamide resin; and epoxy resins.

With respect to the particle diameter of the carrier, the volume average particle diameter is preferably 50 $\mu$m or less, more preferably between 10 and 40 $\mu$m, further preferably between 15 and 35 $\mu$m. When the volume average particle diameter of the carrier is 50 $\mu$m or less, it is possible to improve greasing or density unevenness derived from the deterioration of the rise of charging or the charging distribution and the decrease in the charging amount owing to the reduction of the particle size of the toner particles.

(2) Production of a Full Color Electrophotographic Developer

As stated above, the full color electrophotographic developer of the invention can be produced by mixing the full color electrophotographic toner and the carrier of the invention. The mixing is conducted using a turbula mixer or a V-type blender. The mixing ratio of the toner and the carrier is generally between 1 and 15% by weight, preferably between 2 and 13% by weight in consideration of the developability and the transportability in terms of the toner concentration based on the total amount. When the toner concentration is less than 1% by weight, adverse effects such as a roughness of a solid portion due to the decrease in the amount of the toner transported, the formation of thin spots of a character portion and the decrease in reproducibility of a half tone density sometimes occur. Further, when the toner concentration is more than 15% by weight, the amount of the toner transported is increased, and there sometimes occur transportation disadvantages such as blow-off, dropping and spilling of the toner and charging disadvantages such as broadening of the charging distribution and occurrence of a reversely charged toner by frictional charging of toners.

The life of the developer is mainly determined by deterioration of both the carrier and the toner. As an index showing the deterioration of the two, the amounts of external additives adhered to the carrier can be mentioned. That is, the developer undergoes various stresses in the successive use of the developer, with the result that the separation of the external additives from the surface of the toner or the change in the surface properties of the carrier occurs. As a result, the external additives added to the toner are shifted to the carrier to cause impaction, which leads to the decrease in the charging, the fogging, the contamination in the machine and the image quality defect.

In order to obtain stable charging and a high-quality image even with time, the amounts of external additives in the toner which are shifted and adhered to the carrier are defined to be 0.05% by weight or less based on the amount of the carrier with time, whereby an electrophotographic developer having a long life can be provided. When the amounts of the external additives shifted and adhered to the carrier exceed 0.05% by weight, the external additives on the surface of the toner and the external additives adhered to the surface of the carrier through impaction cause charging interaction, so that the decrease in the chargeability of the developer and various defects occur. For example, when negatively charged external additives are shifted to a positively charged carrier, the positive chargeability of the carrier is decreased, and troubles occur in the frictional charging with the negatively charged toner. Accordingly, the impaction of the external additives on the carrier results in defects such as the contamination inside a machine, the decrease in the image density and the fogging in the background area.

The amounts of the external additives of the toner shifted to the carrier are preferably 0.03% by weight or less based on the amount of the carrier with time.

The term "with time" here referred to indicates a state after conducting the development to a coverage of 50%/A4 sheet using an electrophotographic copier (A-Color 635 manufactured by Fuji Xerox) and conducting the copying test after printing 10,000 sheets. The amounts of the external additives shifted and adhered to the carrier are calculated by measuring, with fluorescent X-rays, the amounts of the external additives adhered to the surface of the carrier obtained by rinsing out the developer after the lapse of time. The rinsing out is a method in which the toner and the carrier in the developer are separated with a triton solution (obtained by diluting polyoxyethylene (10) octylphenyl ether to 0.1% with water) to extract the carrier.

Examples of a method of preventing the external additives from being shifted and adhered to the carrier include mainly the following two.

One of the methods is with respect to the composition of the toner. Specifically, the composition includes a polymer, a wax, a colorant and external additives contained in the toner. Especially, the wax is mentioned as a great cause that influences the surface properties of the toner. The determination of the properties thereof leads to the determination of the fluidity and the fixing properties of the toner, and this influences greatly the amounts of the external additives shifted to the carrier. Further, the coating rate of the external additives or the type and the amount of the surface treating agent are also considered to much influence the amounts of the external additives shifted to the carrier. The determination of the amounts of the external additives shifted to the carrier can be satisfied by using the full color electrophotographic toner of the invention. Further, when the preferable conditions of the invention are used as the conditions on the toner particles and the external additives, the amounts of the external additives shifted to the carrier can be all the more decreased.

Another method is with respect to the composition of the carrier. Especially, the type and the amount of the resin coating layer coated on the surface of the carrier are greatly related with the amounts of the external additives shifted to the carrier. It is considered that they influence the surface properties and the chargeability of the carrier and the static or non-static adhesion of the external additives occurs. The amounts of the external additives shifted to the carrier can be decreased by using the preferable type and amount of the resin coating layer of the carrier.

As the other method of preventing the external additives from being shifted and adhered to the carrier, a method is mentioned in which the mixing ratio of the carrier and the toner is adjusted or a stress from a hard side, such as an auger, trimmer or trickle function, in a developing machine, is decreased.

C: Image Forming Method

The full color electrophotographic developer of the invention is used in an image forming method which includes at least an electrostatic latent image forming step of forming an electrostatic latent image on a surface of an electrostatic latent image holding member, a developing step of developing the electrostatic latent image formed on the surface of the electrostatic latent image holding member using a layer of a developer formed on the surface of the developer holding member to obtain a toner image on the surface of the electrostatic latent image holding member, a transferring step of transferring the toner image onto a surface of a transfer medium, and a fixing step of fixing the toner image on the surface of the transfer medium. The specific construction of these steps is not particularly limited, and a known construction which is used in an electrophotographic method can be employed.

Further, in the image forming method using the full color electrophotographic developer of the invention, the transferring step may be a step of once transferring primarily the toner image formed in the developing step onto an intermediate transfer medium such as an intermediate transfer belt to form a multicolor image and then transferring secondarily the multicolor image onto a surface of a transfer medium. The environmental dependence of the transfer efficiency tends to be more decreased via the intermediate transfer medium. Consequently, the environmental dependence of the image quality is also decreased. Moreover, a copier or a printer can slightly be downsized, and there is a paper adaptability in which an image can be transferred even onto thick paper also. Thus, in recent years, this tends to be increasingly employed in machines using the electrophotography.

Meanwhile, in the image forming method using the intermediate transfer medium, a pressure is exerted between the electrostatic latent image holding member and the intermediate transfer belt in transferring. At this time, the toner agglomeration occurs, poor transfer tends to occur, and it causes image defects such as image dropping. Accordingly, in the image forming method using the intermediate transfer medium, the use of the full color electrophotographic toner appropriately coated with the external additives as in the invention is especially preferable because the fluidity and the storage stability can be improved and the poor transfer and the image defects be prevented.

EXAMPLES

The invention is illustrated specifically by referring to the following Examples and Comparative Examples. However, the invention is not limited thereto. In Examples, "parts" are all on the weight basis.

Examples 1 to 5 and Comparative Examples 1 to 6

Production of Toner Particles (A)

Linear polyester (linear polyester selected from terephthalic acid/bisphenol A·ethylene oxide adduct/cyclohexanedimethanol: Tg=62° C., Mn=4,000, Mw=35,000, acid value=12, hydroxyl value=25): 87 parts Magenta pigment (C. I. Pigment·Red 57): 3 parts Wax (stearyl behenate, heat absorption starting temperature: 58° C., melt viscosity at 120° C.: 50 centipoises): 5 parts The components of the mixture having this composition are premixed, and the mixture is then melt-kneaded with an extruder kneader, and ground with a grinder of a surface-grinding system. The resulting particles are classified into fine particles and coarse particles with an air classifier to obtain magenta toner particles (A) having a volume average particle diameter of 7.5 μm.

Production of External Additives

Titanium oxide $TiO_2$ (core) obtained by the wet method using ilmenite as an ore is prepared. Subsequently, each of the surface treating agents in an amount based on the amount of the core as described in Table 1 is added to a toluene-water mixed solvent (95:5). Further, the core is charged therein, and the ultrasonic dispersion treatment (38 kHz, 60 minutes) is conducted. Then, toluene and water in the dispersion are evaporated with an evaporator. The residue is dried, heat-treated in a drier set at 120° C. for 120 minutes, and crushed with a mortar. Thus, external additives (a) to (j), surface-treated rutile titanium oxides, are obtained.

In the external additives (a) to (d), the mixture is highly dispersed in the ultrasonic dispersion treatment step for a time which is 1.5 times as long as a usual time, and the grinding is conducted with a jet mill of 50 kg/h in the grinding step, whereby the BET specific surface area of titanium oxide is adjusted and the fluidity and the dispersibility are increased.

The outlines of the resulting external additives (a) to (j) and the properties thereof are shown in Table 1.

Example 2

A full color electrophotographic toner (J-2) is produced in the same manner as in Example 1 except that the external additive (a) is replaced with the external additive (b).

The dispersion absolute deviation σ of the external additive (b) to the toner particles (A) of the resulting full color electrophotographic toner (J-2) is measured, and found to be 0.16. The coating rate f of the external additive (b) to the toner particles (A) is calculated, and found to be 40%.

Then, a full color electrophotographic developer (J-2) is produced in the same manner as in Example 1 except that the full color electrophotographic toner (J-2) is used as a toner.

Example 3

A full color electrophotographic toner (J-3) is produced in the same manner as in Example 1 except that the external additive (a) is replaced with the external additive (c) and its amount is changed to 1.5 parts.

The dispersion absolute deviation σ of the external additive (c) to the toner particles (A) of the resulting full color electrophotographic toner (J-3) is measured, and found to be 0.16. The coating rate f of the external additive (c) to the toner particles (A) is calculated, and found to be 45%.

Then, a full color electrophotographic developer (J-3) is produced in the same manner as in Example 1 except that the full color electrophotographic toner (J-3) is used as a toner.

Example 4

One hundred parts of the toner particles (A), 2.0 parts of the external additive (d) and 2.0 parts of negatively charge-

TABLE 1

| Additive | Material of core | BET specific surface area ($m^2/g$) | Volume resistivity (Ωcm) | Form: Appearance Crystal form | Form: Aspect ratio | Hydrophobicity (%) | Average primary particle diameter (nm) | Surface treating agent | Amount of surface treating agent (wt. %) |
|---|---|---|---|---|---|---|---|---|---|
| (a) | $TiO_2$ | 76 | $10^{15}$ | needle · rutile | 10 | 72 | 15 | decyltrimethoxysilane | 16 |
| (b) | $TiO_2$ | 80 | $10^{16}$ | needle · rutile | 10 | 75 | 15 | decyltrimethoxysilane | 20 |
| (c) | $TiO_2$ | 90 | $10^{16}$ | needle · rutile | 9 | 62 | 20 | hexyltrimethoxysilane | 20 |
| (d) | $TiO_2$ | 90 | $10^{14}$ | needle · rutile | 11 | 80 | 25 | decyltrimethoxysilane | 16 |
| (e) | $TiO_2$ | 60 | $10^{8}$ | needle · rutile | 11 | 75 | 25 | isobutyltrimethoxysilane | 16 |
| (f) | $TiO_2$ | 35 | $10^{14}$ | needle · rutile | 10 | 23 | 15 | methyltrimethoxysilane | 20 |
| (g) | $TiO_2$ | 73 | $10^{12}$ | needle · rutile | 11 | 90 | 35 | decyltrimethoxysilane | 16 |
| (h) | $TiO_2$ | 80 | $10^{10}$ | needle · rutile | 10 | 70 | 15 | — | — |
| (i) | $TiO_2$ | 45 | $10^{7}$ | spherical · anatase | 1 | 90 | 25 | decyltrimethoxysilane | 10 |
| (j) | $TiO_2$ | 112 | $10^{8}$ | lamina · anatase | 3 | 65 | 13 | isobutyltrimethoxysilane | 17 |

Example 1

One hundred parts of the toner particles (A), 1.0 part of the external additive (a) and 1.25 parts of negatively chargeable silica having an average primary particle diameter of 40 μm are mixed with a Henschel mixer to produce a full color electrophotographic toner (J-1).

The dispersion absolute deviation a of the external additive (a) to the toner particles (A) of the resulting full color electrophotographic toner (J-1) is measured, and found to be 0.15. The coating rate f of the external additive (a) to the toner particles (A) is calculated, and found to be 40%.

Subsequently, 6 parts of the full color electrophotographic toner (J-1) is added to 100 parts of a carrier obtained by coating ferrite having a particle diameter of 50 μm as a core with a styrene-methyl methacrylate copolymer as a resin coating layer (film thickness: 0.8 μm), and these are mixed with a V-blender to produce a full color electrophotographic developer (J-1).

able silica having an average primary particle diameter of 40 μm are mixed with a Henschel mixer to produce a full color electrophotographic toner (J-4).

The dispersion absolute deviation σ of the external additive (d) to the toner particles (A) of the resulting full color electrophotographic toner (J-4) is measured, and found to be 0.15. The coating rate f of the external additive (d) to the toner particles (A) is calculated, and found to be 48%.

Then, a full color electrophotographic developer (J-4) is produced in the same manner as in Example 1 except that the full color electrophotographic toner (J-4) is used as a toner.

Example 5

One hundred parts of the toner particles (A) and 1.4 parts of the external additive (a) are mixed with a Henschel mixer to produce a full color electrophotographic toner (J-5).

The dispersion absolute deviation σ of the external additive (a) to the toner particles (A) of the resulting full color electrophotographic toner (J-5) is measured, and found to be 0.15. The coating rate f of the external additive (a) to the toner particles (A) is calculated, and found to be 56%.

Comparative Example 1

A full color electrophotographic toner (h-1) is produced in the same manner as in Example 1 except that the external additive (a) is replaced with the external additive (e) and its amount is changed to 2.0 parts.

The dispersion absolute deviation a of the external additive (e) to the toner particles (A) of the resulting full color electrophotographic toner (h-1) is measured, and found to be 0.17. The coating rate f of the external additive (e) to the toner particles (A) is calculated, and found to be 48%.

Then, a full color electrophotographic developer (h-1) is produced in the same manner as in Example 1 except that the full color electrophotographic toner (h-1) is used as a toner.

Comparative Example 2

A full color electrophotographic toner (h-2) is produced in the same manner as in Example 1 except that the external additive (a) is replaced with the external additive (f).

The dispersion absolute deviation σ of the external additive (f) to the toner particles (A) of the resulting full color electrophotographic toner (h-2) is measured, and found to be 0.18. The coating rate f of the external additive (f) to the toner particles (A) is calculated, and found to be 40%.

Then, a full color electrophotographic developer (h-2) is produced in the same manner as in Example 1 except that the full color electrophotographic toner (h-2) is used as a toner.

Comparative Example 3

A full color electrophotographic toner (h-3) is produced in the same manner as in Example 1 except that the external additive (a) is replaced with the external additive (g) and its amount is changed to 2.5 parts.

The dispersion absolute deviation σ of the external additive (g) to the toner particles (A) of the resulting full color electrophotographic toner (h-3) is measured, and found to be 0.18. The coating rate f of the external additive (g) to the toner particles (A) is calculated, and found to be 43%.

Then, a full color electrophotographic developer (h-3) is produced in the same manner as in Example 1 except that the full color electrophotographic toner (h-3) is used as a toner.

Comparative Example 4

A full color electrophotographic toner (h-4) is produced in the same manner as in Example 1 except that the external additive (a) is replaced with the external additive The dispersion absolute deviation σ of the external additive (h) to the toner particles (A) of the resulting full color electrophotographic toner (h-4) is measured, and found to be 0.20. The coating rate f of the external additive (h) to the toner particles (A) is calculated, and found to be 40%.

Then, a full color electrophotographic developer (h-4) is produced in the same manner as in Example 1 except that the full color electrophotographic toner (h-4) is used as a toner.

Comparative Example 5

A full color electrophotographic toner (h-5) is produced in the same manner as in Example 1 except that the external additive (a) is replaced with the external additive (i).

The dispersion absolute deviation σ of the external additive (i) to the toner particles (A) of the resulting full color electrophotographic toner (h-5) is measured, and found to be 0.19. The coating rate f of the external additive (i) to the toner particles (A) is calculated, and found to be 25%.

Then, a full color electrophotographic developer (h-5) is produced in the same manner as in Example 1 except that the full color electrophotographic toner (h-5) is used as a toner.

Comparative Example 6

A full color electrophotographic toner (h-6) is produced in the same manner as in Example 1 except that the external additive (a) is replaced with the external additive (j).

The dispersion absolute deviation σ of the external additive (j) to the toner particles (A) of the resulting full color electrophotographic toner (h-6) is measured, and found to be 0.18. The coating rate f of the external additive (j) to the toner particles (A) is calculated, and found to be 60%.

Then, a full color electrophotographic developer (h-6) is produced in the same manner as in Example 1 except that the full color electrophotographic toner (h-6) is used as a toner.

Image Formation and Evaluation 1:

A copying test of 10,000 sheets is conducted at a low temperature and low humidity (10° C., 15% RH) and at a high temperature and high humidity (28° C., 85% RH) with an electrophotographic copier (A-Color 635 manufactured by Fuji Xerox) using the full color electrophotographic developers (j-1) to (j-5) and (h-1) to (h-6) obtained in Examples and Comparative Examples. Separately from the copying test, the fluidity and the storage stability of the toner are evaluated on the full color electrophotographic toners (j-1) to (j-5) and (h-1) to (h-6). The evaluation items and the details thereof are described below.

Evaluation of an Image Quality:

A degree of fogging and a degree of defect in the interface between a half tone image and a solid image are visually observed on an image after the copying test of 10,000 sheets is completed, and an image quality is evaluated according to the following grades. The results are shown in Table 2.

A: Fogging and Defect are not Observed.

B: Fogging and/or Defect is Slightly Observed.

C: Fogging and/or Defect is Much Observed.

Evaluation of a Retransfer Phenomenon:

When the copying test of 10,000 sheets is completed, the toner remaining on the surface of the photoreceptor (electrostatic latent image holding member) or the intermediate transfer medium is transferred onto a tape. The degree of fogging is visually observed, and the retransfer phenomenon is evaluated according to the following grades. The results are shown in Table 2.

A: Fogging is Not Observed.

B: Fogging is Slightly Observed.

C: Fogging is Much Observed.

Charging Amount:

With respect to the full color electrophotographic toner in each of the full color electrophotographic developers when the copying test of 10,000 sheets is completed, the charging amount is measured with a blow-off measuring unit (blow-off measuring unit "TB 200" manufactured by Toshiba Chemical). The results are shown in Table 2.

Toner Fluidity:

A compression ratio Atn of each of the full color electrophotographic toners is used as an index of the toner fluidity.

$$Atn=\{(\text{toner packed bulk density})-\text{toner aerated bulk density}\}/(\text{toner packed bulk density})$$

The toner packed bulk density and the toner aerated bulk density of the full color electrophotographic toner are measured as follows using a powder tester manufactured by Hosokawa Micron.

Toner Aerated Bulk Density:

A net of 106-μm mesh is put on a funnel of the powder tester. Then, 400 g of the full color electrophotographic toner is charged thereon, and dropped down in a cylindrical container having an inner volume of approximately 25 ml and an inner diameter of approximately 30 mm while being vibrated with a vibration strength of 5.5. After the toner is allowed to stand for 1 minute, the bulk density is measured.

Toner Packed Bulk Density:

After the toner aerated bulk density is measured, a cylinder having the same inner diameter and a length of 50 mm is connected with the container charged with the full color electrophotographic toner as such. The full color electrophotographic toner is dropped down therein through the net of 106-μm mesh on the funnel of the powder tester while being vibrated with a vibration strength of 5.5 to such an extent that the toner does not overflow from the cylinder. The container with the cylinder is tapped with a tapping device of the powder tester for 3 minutes. Then, the cylinder mounted on the upper portion is removed, and the bulk density is measured.

From the results of the compression ratio Atn of the full color electrophotographic toner, the toner fluidity is evaluated according to the following grades. The results are shown in Table 2.

A: Atn≦0.40

B: 0.40<Atn≦0.43

C: 0.43<Atn

Storage Stability:

Twenty grams of each of the full color electrophotographic toners (j-1) to (j-5) and (h-1) to (h-6) obtained in Examples and Comparative Examples is charged into a polyethylene bottle having a volume of 150 cc, and stored in a constant-temperature bath of 47° C. for 24 hours. The toner is allowed to cool to room temperature, and then withdrawn from the bottle. The fusion state of the toner particles is visually observed, and the retransfer phenomenon is evaluated according to the following grades. The results are shown in Table 2.

A: Fusion Does Not Occur at all.

B: Fusion Occurs Slightly, but it is Not Problematic in Actual Use.

C: Fusion Occurs, and it is Problematic in Actual Use.

TABLE 2

| | After copying test of 10,000 sheets | | | | | | | | |
|---|---|---|---|---|---|---|---|---|---|
| | Low temperature, low humidity (10° C., 15% RH) | | | High temperature, high humidity (28° C., 85% RH) | | | | | |
| | Image quality | Fogging | Charging amount (μc/g) | Image quality | Fogging | Charging amount (μc/g) | Toner fluidity | Storage stability | Total evaluation |
| Example 1 | A | A | 18 | A | A | 29 | A | A | A |
| Example 2 | A | A | 16 | A | A | 30 | A | A | A |
| Example 3 | A | A | 15 | A | A | 27 | A | A | A |
| Example 4 | A | A | 20 | A | A | 31 | A | A | A |
| Example 5 | A | A | 17 | A | A | 26 | A | A | A |
| Comparative Example 1 | B | C | 13 | C | C | 20 | A | A | C |
| Comparative Example 2 | C | C | 15 | C | C | 32 | C | C | C |
| Comparative Example 3 | C | C | 9 | C | C | 15 | C | C | C |
| Comparative Example 4 | B | C | 16 | B | C | 24 | A | B | C |
| Comparative Example 5 | C | C | 8 | C | C | 11 | C | C | C |
| Comparative Example 6 | C | C | 10 | B | C | 13 | C | B | C |
| Comparative Example 7 | C | C | 12 | B | C | 14 | A | B | C |
| Comparative Example 8 | C | C | 11 | B | C | 15 | A | B | C |

Table 2 reveals that when the full color electrophotographic developers (j-1) to (j-5) in Examples 1 to 5 are used, the stable image is obtained and that in the repetitive use of the copier, the decrease in the image quality is not observed as a whole, nor is the retransfer phenomenon of the full color electrophotographic toner after the transfer observed.

Meanwhile, when the full color electrophotographic developers (h-1) to (h-6) in Comparative Examples 1 to 6 are used, some of the disadvantages such as the deterioration of the toner fluidity, the decrease in the chargeability due to the embedding of the additives, the decrease in the image quality and the retransfer phenomenon occur with time.

Examples 6 to 8

Production of Toner Particles (B)

Linear Polyester Resin (linear polyester selected from terephthalic acid/bisphenol A·ethylene oxide adduct/cyclohexanedimethanol: Tg=62° C., Mn=4,000, Mw=16,000): 80 parts Cyan pigment (C. I. Pigment·Blue 15:3): 5 parts Releasing agent (long chain normal chain fatty acid saturated alcohol monoester): 5 parts Aliphatic hydrocarbon-aromatic hydrocarbon copolymer petroleum resin: 5 parts Silicone oil-treated silica (average primary particle diameter 16 nm): 5 parts The components of the mixture having this composition are mixed with a Henschel mixer for 10 minutes. The mixture is melt-kneaded with an extruder kneader, then rolled and cooled, ground coarsely and finely, and classified to obtain cyan toner particles (B) having a volume average particle diameter of 7.5 μm.

Preparation of External Additives

External additives shown in Table 3 are prepared.

TABLE 3

Inorganic fine particles added to a toner and properties thereof

| External additive | Composition | Average primary particle diameter (nm) | Specific gravity ($g/cm^3$) |
|---|---|---|---|
| A | i-butyltrimethoxysilane titanium oxide | 20 | 4.1 |
| B | additive (a) | 15 | 4.1 |
| C | silicone oil-treated silica | 40 | 2.2 |
| D | $CH_3(CH_2)_xCH_2OH$ (x ≅ 30) | 7000 | 1.0 |

Production of Full Color Electrophotographic Toner and Developer

The external additives A to D shown in Table 3 are added to the toner particles (B) in amounts shown in Table 4, and these are mixed with a Henschel mixer to produce full color electrophotographic toners (J-6) to (J-8). The dispersion absolute deviation a of the external additive (a) to the toner particles (B) of the resulting full color electrophotographic toners (J-6) to (J-8) is measured, and the results are shown in Table 4.

TABLE 4

| | Type of toner | Amount of external additive (wt. %) A | B | C | D | Dispersion absolute deviation σ |
|---|---|---|---|---|---|---|
| Example 6 | (J-6) | 1.0 | 0.8 | 1.0 | 0.3 | 0.15 |
| Example 7 | (J-7) | 1.0 | 1.0 | 1.2 | 0.3 | 0.15 |
| Example 8 | (J-8) | 1.0 | 1.2 | 1.4 | 0.3 | 0.16 |

Ten parts of each of the resulting full color electrophotographic toners (J-6) to (J-8) is mixed with 100 parts of a carrier obtained by coating a ferrite core with 2% by weight of a styrene-methyl methacrylate copolymer and having a volume average particle diameter of 50 μm. In this manner, full color electrophotographic developers (J-6) to (J-8) are obtained.

Image Formation and Evaluation 2:

Image formation and evaluation of various properties are conducted using the full color electrophotographic toners and developers obtained in Examples 6 to 8. The evaluation items and the details thereof are described below.

Storage Stability:

Each of the full color electrophotographic toners (J-6) to (J-8) obtained in Examples 6 to 8 is charged into a toner cartridge (installed in an electrophotographic copier to be described later), and allowed to stand at a high temperature and high humidity (40° C., 95% RH) for 10 days.

Each of the full color electrophotographic developers (J-6) to (J-8) is charged into a commercial electrophotographic copier (A-Color 635 remodeled such that the fixing conditions can be adjusted; manufactured by Fuji Xerox), and the toner cartridge charged with each of the corresponding full color electrophotographic toners which has been allowed to stand at the high temperature and high humidity is installed therein. A solid image 2 cm in length and 10 cm in width with an image area ratio of 100% is formed on FX-J paper of A3 size (manufactured by Fuji Xerox) in a transporting direction of paper in the fixing.

Prior to the formation of the solid image, the unfixed sample before passes through a fixing device is withdrawn, and a toner amount per unit area (TMA) is measured, and adjusted to between 0.6 and 0.8 $mg/cm^2$. A method of measuring TMA ($mg/cm^2$) is as follows.

Measurement of TMA:

An unfixed solid image having an area of 10 $cm^2$ is formed on paper, and weighed. Subsequently, the toner on the paper is removed by air blow, and the weight of the paper alone is measured. TMA ($mg/cm^2$) is calculated from the difference in weight before and after the removal of the toner.

The fixing conditions of the solid image are that a process speed is 106 mm/sec, a temperature of a heating roller is between 160 and 170° C. and a temperature of a pressure roller is between 160 and 170° C. The test is conducted on condition that oil as a releasing agent is substantially absent on the surface of the fixing roller by stopping the supply of the oil as the releasing agent to the fixing roller. The details of the fixing device are as follows.

Details of the Fixing Device:

Heating roller
- diameter: 50 mm
- core roller: made of aluminum
- coating layer: silicone rubber/PFA (perfluoroethylene-perfluoroalkylvinyl ether) resin (outside: thickness 40 μm)

Pressure roller
- diameter: 50 mm
- core roller: made of aluminum
- coating layer: fluororubber (thickness 3 mm)
- nip width: 5 mm In this manner, with respect to the full color electrophotographic toners and the full color electrophotographic developers, the copying test of 1,000 sheets is conducted. After 1,000 sheets are printed out, the number of samples in which image defects considered to occur due to formation of the agglomerate of the toner, such as a color spot, a color stripe and an image drop are generated is counted, and the storage stability is evaluated according to the following grades. The results are shown in Table 5.

A: A Rate of Occurrence of Image Quality Defect is 1% or Less.

B: A Rate of Occurrence of Image Quality Defect Exceeds 1% and 5% or Less.

C: A rate of Occurrence of Image Quality Defect is 10% or More.

Offset Property:

An unfixed toner solid image 5 cm in length and 4 cm in width is formed on transfer paper of A4 size with a commercial electrophotographic copier (A-Color 635 manufactured by Fuji Xerox) while TMA is adjusted to between 0.6 and 0.8 $mg/cm^2$. A method of adjusting TMA is as follows.

The fixing test is conducted using A-Color 635 remodeled such that the temperature of the fixing roller can freely be determined and monitored, on condition that oil as a releasing agent is substantially absent on the surface of the fixing roller by stopping the supply of the oil as the releasing agent to the fixing roller. The surface temperature of the fixing roller is changed stepwise (at intervals of 10° C.), and the unfixed toner image is fixed on the surface of the transfer paper at each surface temperature. At this time, it is observed whether or not the toner from the fixing roller contaminated the blank space of the paper. The temperature region in which the contamination does not occur is defined as an offset-free temperature region, and used as an evaluation index of the offset.

Transferability:

An unfixed toner solid image 5 cm in length and 4 cm in width is formed as in the offset property. The number of samples in which image defects considered to occur due to formation of the agglomerate of the toner, such as an image drop and a color spot are generated is counted, and the transferability is evaluated according to the following grades. The results are shown in Table 5.

A: A Rate of Occurrence of Image Quality Defect is 1% or Less.

B: A Rate of Occurrence of Image Quality Defect Exceeds 1% and 5% or Less.

C: A Rate of Occurrence of Image Quality Defect Exceeds 1% and 10% or More.

Retention of a Developer:

Such a fixed image that TMA reaches 0.2 to 0.3 mg/cm$^2$ is successively printed at a low temperature and low humidity (10° C., 15% RH) using a commercial electrophotographic copier (A-Color 635 manufactured by Fuji Xerox). The copying test is conducted until the charging amount of the developer is decreased to 70% or less of the initial value. From the results, the developer retention and the storage stability are evaluated according to the following grades. The results are shown in Table 5.

A: Even when the number of printed sheets is 500,000 or more, the charging amount is 70% or more of the initial value.

B: When the number of printed sheets is 200,000 to less than 500,000, the charging amount is decreased to 70% of the initial value.

C: When the number of printed sheets is less than 200,000, the charging amount is decreased to 70% of the initial value.

TABLE 5

| Ex. No. | Coating rate of external additive (%) | Evaluation items: Storage stability | Offset property | Trans-ferability | Developer retention | Total evaluation |
|---|---|---|---|---|---|---|
| 6 | 82.77 | A | 120–190° C. A | A | A | A |
| 7 | 94.46 | A | 120–190° C. A | A | A | A |
| 8 | 106.15 | A | 120–190° C. A | A | A | A |

In Example 6, the rate of occurrence of image quality defect is approximately 0.7% in the storage stability test, and this proves that the agglomeration of the toner does not occur even in the storage at the high temperature and high humidity. In reality, when the developer and the toner after the completion of the test are sieved through a 200-$\mu$m mesh, no agglomerate of the toner can be identified. Further, in the fixing test also, the offset-free region is obtained in the wide range of 120 to 190° C. Still further, no defect occurs at all in the transfer test either. Furthermore, in the test of the developer retention as well, even when 500,000 or more sheets are printed, the charging amount is 81% of the initial value. Thus, the excellent results are shown in all the items of the storage stability, the fixability, the transferability and the developer retention.

In Example 7, the rate of occurrence of image quality defect is approximately 0.5% in the storage stability test, and the excellent results are shown in all the items.

In Example 8 also, the rate of occurrence of image quality defect is approximately 0.5% in the storage stability test, and the excellent results are shown in all the items.

Examples 9 to 12

Preparation of a Wax

Waxes shown in Table 6 are prepared.

TABLE 6

| Wax | Material | Melt viscosity (cPs) | Rate of penetration (dmm) | Number average molecular weight | Acid value |
|---|---|---|---|---|---|
| A | carnauba | 10 | 2 | 550 | 10 |
| B | polyethylene | 5 | 2 | 655 | 0 |
| C | stearyl behenate | 40 | 2 | 800 | 12 |

Production of Toner Particles a) Toner Particles (C)

Linear polyester (linear polyester selected from terephthalic acid/bisphenol A·ethylene oxide adduct/cyclohexanedimethanol: Tg=62° C., Mn=4,000, Mw=35,000, acid value=12, hydroxyl value=25): 87 parts Magenta pigment (C. I. Pigment·Red 57): 3 parts Wax A: 5 parts The components of the mixture having this composition are premixed, and the mixture is then melt-kneaded with an extruder kneader, and ground with a grinder of a surface-grinding system. The resulting particles are classified into fine particles and coarse particles with an air classifier to obtain magenta toner particles (C) having a volume average particle diameter of 7.5 $\mu$m. At this time, the amount of the wax on the surfaces of the toner particles is 50%.

b) Toner Particles (D)

Magenta toner particles (D) having a volume average particle diameter of 7.9 $\mu$m are obtained in the same manner as in the production of the toner particles (C) except that the wax A is replaced with the wax B. At this time, the amount of the wax on the surfaces of the toner particles is 52%.

c) Toner Particles (E)

Magenta toner particles (E) having a volume average particle diameter of 7.4 $\mu$m are obtained in the same manner as in the production of the toner particles (C) except that the wax A is replaced with the wax C. At this time, the amount of the wax on the surfaces of the toner particles is 45%.

Production of a Carrier a) Carrier A

Ferrite particles (average particle diameter 45 $\mu$m): 100 parts

Toluene: 14 parts

Perfluorooctylethyl methacrylate-methyl methacrylate copolymer (copolymerization ratio: 8:2, weight average molecular weight Mw: 40,000): 1.6 parts Carbon black (Vulcan XC 72 made by Cabot): 0.16 part Melamine resin (average particle diameter 0.3 $\mu$m): 0.3 part The components except the ferrite particles are dispersed with a stirrer for 10 minutes to prepare a solution for forming a resin coating layer. This solution for forming the resin coating layer and the ferrite particles are charged in a vacuum deaeration-type kneader, and stirred at 60° C. for 30 minutes. Then, toluene is distilled off under reduced pressure to obtain a carrier A.

b) Carrier B

A carrier B is produced in the same manner as in the production of the carrier A except that the perfluorooctylethyl methacrylate-methyl methacrylate copolymer is replaced with polychlorotrifluoroethylene.

Example 9

One hundred parts of the toner particles (C) are mixed with 1.0 part of the external additive (a) and 1.25 parts of negatively chargeable silica having an average particle diameter of 40 μm with a Henschel mixer to produce a full color electrophotographic toner (J-9) of which the coating rate of all the external additives to the toner particles is 48%. The dispersion absolute deviation a of the external additive (a) to the toner particles (C) of the resulting full color electrophotographic toner (J-9) is measured, and found to be 0.15.

Subsequently, 6 parts of the full color electrophotographic toner (J-9) are added to 100 parts of the carrier A, and these are mixed with a V-type blender to produce a full color electrophotographic developer (J-9).

Example 10

A full color electrophotographic toner (J-10) is produced as in Example 1 except that the toner particles (C) are replaced with the toner particles (D). The dispersion absolute deviation σ of the external additive (a) to the toner particles (D) of the resulting full color electrophotographic toner (J-10) is measured, and found to be 0.16.

Subsequently, 6 parts of the full color electrophotographic toner (J-10) are added to 100 parts of the carrier A, and these are mixed with a V-type blender to produce a full color electrophotographic developer (J-10).

Example 11

A full color electrophotographic toner (J-11) is produced as in Example 1 except that the toner particles (C) are replaced with the toner particles (E). The dispersion absolute deviation a of the external additive (a) to the toner particles (E) of the resulting full color electrophotographic toner (J-11) is measured, and found to be 0.14.

Subsequently, 6 parts of the full color electrophotographic toner (J-11) are added to 100 parts of the carrier A, and these are mixed with a V-type blender to produce a full color electrophotographic developer (J-11).

Example 12

The same full color electrophotographic toner (J-9) as that in Example 9 is used in this Example. A full color electrophotographic developer (J-12) is produced in the same manner as in Example 1 except that the carrier A is replaced with the carrier B.

Image Formation and Evaluation 3:

A copying test of 50,000 sheets is conducted with a 50% coverage/A4 with an electrophotographic copier (A-Color 635 manufactured by Fuji Xerox) using the full color electrophotographic developers (j-9) to (j-12) obtained in Examples and Comparative Examples. After the completion of the copying test of 10,000 sheets and 50,000 sheets, the evaluation is conducted with respect to the following items.

Charging Amount:

Regarding the full color electrophotographic toner of each of the full color electrophotographic developers after the completion of the copying test of 10,000 sheets and 50,000 sheets, the charging amount is measured with the same blow-off measuring unit as described in Examples 1 to 5 and Comparative Examples 1 to 6. The results are shown in Table 7.

Evaluation of an Image Quality:

With respect to the image after the completion of the copying test of 10,000 sheets and 50,000 sheets, the image quality is evaluated by the same method and the same grades as described in Examples 1 to 5 and Comparative Examples 1 to 6. The results are shown in Table 7.

Image Density:

The image density of the solid portion is measured using a Macbeth densitometer (RD-914 manufactured by Macbeth). The results are shown in Table 7.

Offset Property:

The offset property is evaluated by the same method and the same evaluation grades as described in Examples 6 to 8. The results are shown in Table 7.

Amounts of External Additives Shifted and Adhered:

The amounts of the external additives of the toner shifted and adhered to the carrier (hereinafter simply referred to as "amounts of external additives shifted and adhered") are measured after the copying test of 10,000 sheets and 50,000 sheets (so-called "with time").

TABLE 7

| | After copying test of 10,000 sheets (50% coverage/A4) | | | | After copying test of 50,000 sheets (50% coverage/A4) | | | | |
|---|---|---|---|---|---|---|---|---|---|
| Ex. No. | Charging amount (μC/g) | Image quality | Image density | Amounts of additives shifted and adhered (wt. %) | Charging amount (μC/g) | Image quality | Image density | Amounts of additives shifted and adhered (wt. %) | Offset property |
| 9 | 23 | A | 1.53 | 0.025 | 21 | A | 1.49 | 0.037 | 120–190° C. A |
| 10 | 21 | A | 1.51 | 0.031 | 20 | A | 1.47 | 0.041 | 120–190° C. A |
| 11 | 22 | B | 1.50 | 0.033 | 19 | B | 1.46 | 0.042 | 120–190° C. A |
| 12 | 20 | A | 1.50 | 0.032 | 18 | A | 1.46 | 0.039 | 120–190° C. A |

The results in Table 7 reveal that in the full color electrophotographic developers in Examples 9 to 12, the amounts of external additives shifted and adhered are small, the fogging and the defect in the interface portion of the half tone and the solid image are not observed as a whole even in the repetitive use of the copier and the stable good image is obtained.

As has been stated above, according to the invention, the full color electrophotographic toner, the full color electrophotographic developer and the image forming method can be provided in which the retransfer phenomenon of the transferred toner can be prevented, the chargeability and the transferability are not problematic at all, the charging amount of the toner in the long-term use can be rendered appropriate and stable and the fluidity is also excellent.

Further, the full color electrophotographic toner of the invention further contains silica fine particles as one of the external additives, and the amounts of the silica fine particles and rutile titanium oxide and the total coating rate thereof are appropriately adjusted, whereby the chargeability, the storage stability and the fluidity can be improved.

Still further, in the full color electrophotographic developer of the invention, the amounts of the external additives of the toner which are shifted and adhered to the carrier are appropriately adjusted, whereby the stable charging and the good-quality image can be provided with time.

The entire disclosure of Japanese Patent Application No. 2000-006744 filed on Jan. 14, 2000 including specification, claims, drawings and abstract is incorporated herein by reference in its entirety.

What is claimed is:

1. A full color electrophotographic toner comprising toner particles containing at least a binder resin, a colorant and a wax, and external additives, wherein the external additives contain a rutile titanium oxide having a volume resistivity of $1\times10^{14}$ to $1\times10^{8}$ Ωcm, and the rutile titanium oxide has a dispersion absolute deviation σ of 0.17 or less and an aspect ratio of 5 or more.

2. The full color electrophotographic toner as claimed in claim 1, wherein the rutile titanium oxide has a BET specific surface area between 40 and 120 $m^2/g$.

3. The full color electrophotographic toner as claimed in claim 1, wherein the rutile titanium oxide is treated with a surface treating agent.

4. The full color electrophotographic toner as claimed in claim 1, wherein the rutile titanium oxide has an average primary particle diameter of 5 to 25 nm.

5. The full color electrophotographic toner as claimed in claim 1, wherein the rutile titanium oxide has a hydrophobicity of 40 to 100%.

6. The full color electrophotographic toner as claimed in claim 1, wherein the surface treating agent is at least one silicon compound selected from silicon compounds represented by formulas (I) to (III)

$$R_1Si(X)_3 \quad (I)$$

$$R_1R_2Si(X)_2 \quad (II)$$

$$R_1R_2R_3SiX \quad (III)$$

wherein $R_1$ represents an alkyl group having 1 to 20 carbon atoms or a perfluoroalkyl group having 1 to 20 carbon atoms, $R_2$ and $R_3$ each represent a hydrogen atom, an alkyl group having 1 to 20 carbon atoms, a perfluoroalkyl group having 1 to 20 carbon atoms or an aryl group having 6 to 20 carbon atoms, and X represents a chlorine atom, an alkoxy group, NCO or an acetoxy group.

7. The full color electrophotographic toner as claimed in claim 1, wherein a coating rate of the rutile titanium oxide to the surfaces of the toner particles is between 20 and 100%.

8. The full color electrophotographic toner as claimed in claim 1, wherein the toner further contains silica fine particles.

9. The full color electrophotographic toner as claimed in claim 8, wherein the silica fine particles are added to the toner particles in an amount between 0.8 and 5.5% by weight, and the rutile titanium oxide particles are added to the toner particles in an amount between 0.8 and 3% by weight.

10. The full color electrophotographic toner as claimed in claim 1, wherein the wax is added in the toner particles in an amount between 1 and 20% by weight.

11. The full color electrophotographic toner as claimed in claim 1, wherein the wax in the toner particles having a number average molecular weight between 100 and 1,500.

12. The full color electrophotographic toner as claimed in claim 1, wherein the wax on the surfaces of the toner particles is in an amount between 20 and 80%.

13. A full color electrophotographic developer comprising a toner and a carrier, the toner being the full color electrophotographic toner as claimed in claim 1.

14. The full color electrophotographic developer as claimed in claim 13, wherein the carrier is a resin-coated carrier.

15. An image forming method which comprises at least an electrostatic latent image forming step of forming an electrostatic latent image on a surface of an electrostatic latent image holding member, a developing step of developing the electrostatic latent image formed on the surface of the electrostatic latent image holding member using a layer of a developer formed on a surface of a developer holding member to obtain a toner image on the surface of the electrostatic latent image holding member, a transferring step of transferring the toner image onto a surface of a transfer medium, and a fixing step of fixing the toner image on the surface of the transfer medium, the developer containing the full color electrophotographic toner as claimed in claim 1.

16. The image forming method as claimed in claim 15, wherein the transferring step is a step of once transferring primarily the toner image formed in the developing step onto an intermediate transfer medium such as an intermediate transfer belt to form a multicolor image and then transferring secondarily the multicolor image onto a surface of a transfer medium.

* * * * *